US011657774B2

(12) United States Patent
Amundson et al.

(10) Patent No.: US 11,657,774 B2
(45) Date of Patent: May 23, 2023

(54) APPARATUS AND METHODS FOR DRIVING DISPLAYS

(71) Applicant: E INK CORPORATION, Billerica, MA (US)

(72) Inventors: Karl Raymond Amundson, Cambridge, MA (US); Teck Ping Sim, Acton, MA (US)

(73) Assignee: E Ink Corporation, Billerica, MA (US)

( * ) Notice: Subject to any disclaimer, the term of this patent is extended or adjusted under 35 U.S.C. 154(b) by 0 days.

(21) Appl. No.: 17/948,224

(22) Filed: Sep. 19, 2022

(65) Prior Publication Data

US 2023/0009743 A1 Jan. 12, 2023

Related U.S. Application Data

(60) Continuation-in-part of application No. 17/011,566, filed on Sep. 3, 2020, now Pat. No. 11,450,286, which is a division of application No. 15/266,554, filed on Sep. 15, 2016, now Pat. No. 10,803,813.

(60) Provisional application No. 62/370,703, filed on Aug. 3, 2016, provisional application No. 62/261,104, filed on Nov. 30, 2015, provisional application No. 62/219,606, filed on Sep. 16, 2015.

(51) Int. Cl.
*G09G 3/34* (2006.01)

(52) U.S. Cl.
CPC ..... *G09G 3/344* (2013.01); *G09G 2300/04* (2013.01); *G09G 2300/08* (2013.01); *G09G 2310/0251* (2013.01); *G09G 2310/08* (2013.01); *G09G 2320/0204* (2013.01); *G09G 2320/0257* (2013.01)

(58) Field of Classification Search
CPC ..... G09G 3/344; G09G 2310/0251; G09G 2310/08; G09G 2320/0204; G09G 2320/0257; G09G 2330/027; G09G 2330/028
See application file for complete search history.

(56) References Cited

U.S. PATENT DOCUMENTS

| | | | |
|---|---|---|---|
| 4,418,346 | A | 11/1983 | Batchelder |
| 5,717,418 | A | 2/1998 | Shapiro et al. |
| 5,777,782 | A | 7/1998 | Sheridon |
| 5,808,783 | A | 9/1998 | Crowley |

(Continued)

FOREIGN PATENT DOCUMENTS

| | | | |
|---|---|---|---|
| EP | 1462847 | A1 | 9/2004 |
| JP | S635368 | A | 1/1988 |

(Continued)

OTHER PUBLICATIONS

Wood, D., "An Electrochromic Renaissance?" Information Display, 18(3), 24 (Mar. 2002).

(Continued)

*Primary Examiner* — Xuemei Zheng
(74) *Attorney, Agent, or Firm* — Jason P. Colangelo

(57) ABSTRACT

An apparatus for driving an electro-optic display may comprise a first switch designed to supply a voltage to the electro-optic display during a first driving phase, a second switch designed to control the voltage during a second driving phase and a resistor coupled to the first and second switches for controlling the rate of decay of the voltage during the second driving phase.

24 Claims, 16 Drawing Sheets

(56) References Cited

U.S. PATENT DOCUMENTS 5,872,552 A 2/1999 Gordon, II et al.
5,930,026 A 7/1999 Jacobson et al.
6,054,071 A 4/2000 Mikkelsen, Jr.
6,055,091 A 4/2000 Sheridon et al.
6,097,531 A 8/2000 Sheridon
6,128,124 A 10/2000 Silverman
6,130,774 A 10/2000 Albert et al.
6,137,467 A 10/2000 Sheridon et al.
6,144,361 A 11/2000 Gordon, II et al.
6,147,791 A 11/2000 Sheridon
6,184,856 B1 2/2001 Gordon, II et al.
6,225,971 B1 5/2001 Gordon, II et al.
6,241,921 B1 6/2001 Jacobson et al.
6,271,823 B1 8/2001 Gordon, II et al.
6,301,038 B1 10/2001 Fitzmaurice et al.
6,445,489 B1 9/2002 Jacobson et al.
6,504,524 B1 1/2003 Gates et al.
6,512,354 B2 1/2003 Jacobson et al.
6,531,997 B1 3/2003 Gates et al.
6,672,921 B1 1/2004 Liang et al.
6,753,999 B2 6/2004 Zehner et al.
6,788,449 B2 9/2004 Liang et al.
6,825,970 B2 11/2004 Goenaga et al.
6,847,193 B2 1/2005 Sakuragi
6,866,760 B2 3/2005 Paolini, Jr. et al.
6,867,760 B2 3/2005 Yanagi et al.
6,870,657 B1 3/2005 Fitzmaurice et al.
6,900,851 B2 5/2005 Morrison et al.
6,922,276 B2 7/2005 Zhang et al.
6,927,755 B2 8/2005 Chang
6,950,220 B2 9/2005 Abramson et al.
6,982,178 B2 1/2006 LeCain et al.
6,995,550 B2 2/2006 Jacobson et al.
7,002,542 B2 2/2006 Lee
7,002,728 B2 2/2006 Pullen et al.
7,012,600 B2 3/2006 Zehner et al.
7,023,420 B2 4/2006 Comiskey et al.
7,034,783 B2 4/2006 Gates et al.
7,061,166 B2 6/2006 Kuniyasu
7,061,662 B2 6/2006 Chung et al.
7,072,095 B2 7/2006 Liang et al.
7,075,502 B1 7/2006 Drzaic et al.
7,116,318 B2 10/2006 Amundson et al.
7,116,466 B2 10/2006 Whitesides et al.
7,119,772 B2 10/2006 Amundson et al.
7,144,942 B2 12/2006 Zang et al.
7,170,670 B2 1/2007 Webber
7,177,066 B2 2/2007 Chung et al.
7,193,625 B2 3/2007 Danner et al.
7,202,847 B2 4/2007 Gates
7,236,291 B2 6/2007 Kaga et al.
7,242,514 B2 7/2007 Chung et al.
7,259,744 B2 8/2007 Arango et al.
7,312,784 B2 12/2007 Baucom et al.
7,321,459 B2 1/2008 Masuda
7,327,511 B2 2/2008 Whitesides et al.
7,369,299 B2 5/2008 Sakurai et al.
7,408,699 B2 8/2008 Wang et al.
7,411,719 B2 8/2008 Paolini, Jr. et al.
7,420,549 B2 9/2008 Jacobson et al.
7,453,445 B2 11/2008 Amundson
7,492,339 B2 2/2009 Amundson
7,495,819 B2 2/2009 Sakurai et al.
7,525,719 B2 4/2009 Yakushiji et al.
7,528,822 B2 5/2009 Amundson et al.
7,535,624 B2 5/2009 Amundson et al.
7,583,251 B2 9/2009 Arango et al.
7,602,374 B2 10/2009 Zehner et al.
7,612,760 B2 11/2009 Kawai
7,646,358 B2 1/2010 Hattori et al.
7,646,530 B2 1/2010 Takagi et al.
7,679,599 B2 3/2010 Kawai
7,679,813 B2 3/2010 Liang et al.
7,679,814 B2 3/2010 Paolini, Jr. et al.
7,683,606 B2 3/2010 Kang et al.
7,714,811 B2 5/2010 Kim
7,715,088 B2 5/2010 Liang et al.
7,839,564 B2 11/2010 Whitesides et al.
7,859,742 B1 12/2010 Chiu et al.
7,952,557 B2 5/2011 Amundson
7,956,841 B2 6/2011 Albert et al.
7,982,479 B2 7/2011 Wang et al.
7,999,787 B2 8/2011 Amundson et al.
8,004,485 B2 8/2011 Nakasuka
8,009,348 B2 8/2011 Zehner et al.
8,077,141 B2 12/2011 Duthaler et al.
8,125,501 B2 2/2012 Amundson et al.
8,139,050 B2 3/2012 Jacobson et al.
8,174,490 B2 5/2012 Whitesides et al.
8,217,881 B2 7/2012 Yanagi et al.
8,243,013 B1 8/2012 Sprague et al.
8,274,472 B1 9/2012 Wang et al.
8,289,250 B2 10/2012 Zehner et al.
8,300,006 B2 10/2012 Zhou et al.
8,314,784 B2 11/2012 Ohkami et al.
8,373,649 B2 2/2013 Low et al.
8,384,658 B2 2/2013 Albert et al.
8,405,648 B2 3/2013 Cheng et al.
8,456,414 B2 6/2013 Lin et al.
8,462,102 B2 6/2013 Wong et al.
8,484,490 B2 7/2013 Yamato et al.
8,514,168 B2 8/2013 Chung et al.
8,537,105 B2 9/2013 Chiu et al.
8,558,783 B2 10/2013 Wilcox et al.
8,558,786 B2 10/2013 Lin
8,558,855 B2 10/2013 Sprague et al.
8,564,531 B2 * 10/2013 Ozawa ..... G09G 3/344 345/107
8,576,164 B2 11/2013 Sprague et al.
8,576,259 B2 11/2013 Lin et al.
8,605,032 B2 12/2013 Liu et al.
8,625,039 B2 1/2014 Tajiri et al.
8,633,889 B2 1/2014 Umezaki
8,643,595 B2 2/2014 Chung et al.
8,665,206 B2 3/2014 Lin et al.
8,681,191 B2 3/2014 Yang et al.
8,710,876 B2 4/2014 Lobsiger et al.
8,810,525 B2 8/2014 Sprague
8,928,562 B2 1/2015 Gates et al.
8,928,641 B2 1/2015 Chiu et al.
8,976,444 B2 3/2015 Zhang et al.
9,013,394 B2 4/2015 Lin
9,019,197 B2 4/2015 Lin
9,019,198 B2 4/2015 Lin et al.
9,019,318 B2 4/2015 Sprague et al.
9,082,352 B2 7/2015 Cheng et al.
9,183,772 B2 11/2015 Tsuchi
9,197,704 B2 11/2015 Sun et al.
9,218,773 B2 12/2015 Sun et al.
9,224,338 B2 12/2015 Chan et al.
9,224,342 B2 12/2015 Sprague et al.
9,224,344 B2 * 12/2015 Chung ..... G09G 3/344
9,230,492 B2 1/2016 Harrington et al.
9,251,736 B2 2/2016 Lin et al.
9,262,973 B2 * 2/2016 Wu ..... G09G 3/344
9,279,906 B2 3/2016 Kang
9,299,294 B2 3/2016 Lin et al.
9,390,066 B2 7/2016 Smith et al.
9,390,661 B2 * 7/2016 Chiu ..... G09G 3/344
9,460,666 B2 10/2016 Sprague et al.
9,495,918 B2 11/2016 Harrington et al.
9,501,981 B2 11/2016 Lin et al.
9,513,743 B2 12/2016 Sjodin et al.
9,514,667 B2 12/2016 Lin
9,612,502 B2 4/2017 Danner et al.
9,620,048 B2 4/2017 Sim et al.
9,672,766 B2 6/2017 Sjodin
9,691,333 B2 6/2017 Cheng et al.
9,721,495 B2 8/2017 Harrington et al.
9,792,861 B2 10/2017 Chang et al.
9,792,862 B2 10/2017 Hung et al.
10,163,406 B2 12/2018 Sim et al.
10,229,641 B2 3/2019 Yang et al.
10,319,313 B2 6/2019 Harris et al.

(56) References Cited

U.S. PATENT DOCUMENTS

| | | | |
|---|---|---|---|
| 10,339,876 | B2 | 7/2019 | Lin et al. |
| 10,444,553 | B2 | 10/2019 | Laxton |
| 10,672,350 | B2 | 6/2020 | Amundson et al. |
| 2003/0102858 | A1 | 6/2003 | Jacobson et al. |
| 2004/0246562 | A1 | 12/2004 | Chung et al. |
| 2005/0253777 | A1 | 11/2005 | Zehner et al. |
| 2006/0087479 | A1 | 4/2006 | Sakurai et al. |
| 2006/0087489 | A1 | 4/2006 | Sakurai et al. |
| 2006/0209008 | A1 | 9/2006 | Nihei et al. |
| 2006/0214906 | A1 | 9/2006 | Kobayashi et al. |
| 2006/0232547 | A1 | 10/2006 | Johnson et al. |
| 2006/0267906 | A1 | 11/2006 | Shie |
| 2006/0279526 | A1 | 12/2006 | Zhou et al. |
| 2007/0103427 | A1 | 5/2007 | Zhou et al. |
| 2007/0176912 | A1 | 8/2007 | Beames et al. |
| 2008/0024429 | A1 | 1/2008 | Zehner |
| 2008/0024482 | A1 | 1/2008 | Gates et al. |
| 2008/0136774 | A1 | 6/2008 | Harris et al. |
| 2008/0303780 | A1 | 12/2008 | Sprague et al. |
| 2009/0174651 | A1 | 7/2009 | Jacobson et al. |
| 2010/0194733 | A1 | 8/2010 | Lin et al. |
| 2010/0194789 | A1 | 8/2010 | Lin et al. |
| 2010/0265561 | A1 | 10/2010 | Gates et al. |
| 2010/0289785 | A1 | 11/2010 | Sawabe |
| 2011/0063314 | A1 | 3/2011 | Chiu et al. |
| 2011/0175875 | A1 | 7/2011 | Lin et al. |
| 2011/0221740 | A1 | 9/2011 | Yang et al. |
| 2012/0001957 | A1 | 1/2012 | Liu et al. |
| 2012/0098740 | A1 | 4/2012 | Chiu et al. |
| 2013/0044085 | A1 | 2/2013 | Lin et al. |
| 2013/0063333 | A1 | 3/2013 | Arango et al. |
| 2013/0249782 | A1 | 9/2013 | Wu et al. |
| 2014/0204012 | A1 | 7/2014 | Wu et al. |
| 2014/0240210 | A1 | 8/2014 | Wu et al. |
| 2014/0253425 | A1 | 9/2014 | Zalesky et al. |
| 2014/0293398 | A1 | 10/2014 | Wang et al. |
| 2015/0005720 | A1 | 1/2015 | Zang et al. |
| 2015/0262255 | A1 | 9/2015 | Khajehnouri et al. |
| 2016/0012710 | A1 | 1/2016 | Lu et al. |
| 2016/0180777 | A1 | 6/2016 | Lin et al. |
| 2016/0365057 | A1 | 12/2016 | Zeng et al. |
| 2017/0337879 | A1* | 11/2017 | Oishi ..... G02F 1/1368 |

FOREIGN PATENT DOCUMENTS

| | | | |
|---|---|---|---|
| JP | 2011033854 | A | 2/2011 |
| KR | 20040024361 | A | 3/2004 |
| KR | 20080090185 | A | 10/2008 |
| TW | 200535773 | A | 11/2005 |
| WO | 2004079442 | A1 | 9/2004 |

OTHER PUBLICATIONS

O'Regan, B. et al., "A Low Cost, High-efficiency Solar Cell Based on Dye-sensitized colloidal TiO2 Films", Nature, vol. 353, pp. 737-740 (Oct. 24, 1991).

Bach, Udo et al., "Nanomaterials-Based Electrochromics for Paper-Quality Displays", Adv. Mater, vol. 14, No. 11, pp. 345-348, (Jun. 5, 2002).

Hayes, R.A. et al., "Video-Speed Electronic Paper Based on Electrowetting", Nature, vol. 425, No. 25, pp. 383-385 (Sep. 2003).

Kitamura, T. et al., "Electrical toner movement for electronic paper-like display", Asia Display/IDW '01, pp. 1517-1520, Paper HCS1-1 (2001).

Yamaguchi, Y. et al., "Toner display using insulative particles charged triboelectrically", Asia Display/IDW '01, pp. 1729-1730, Paper AMD4-4 (2001).

Korean Intellectual Property Office; PCT/US2016/052032; International Search Report and Written Opinion; dated Dec. 21, 2016.

European Patent Office, EP Appl. No. 16847345.2, Extended European Search Report, dated May 6, 2019.

* cited by examiner

APPARATUS AND METHODS FOR DRIVING DISPLAYS

REFERENCE TO RELATED APPLICATIONS

This application is a continuation-in-part of U.S. application Ser. No. 17/011,566, filed Sep. 3, 2020, now U.S. Pat. No. 11,450,286, which is a division of U.S. application Ser. No. 15/266,554, filed Sep. 15, 2016, now U.S. Pat. No. 10,803,813, which claims the benefit of U.S. Provisional Application Ser. No. 62/219,606, filed Sep. 16, 2015

This application is also related to U.S. Provisional Application Ser. No. 62/370,703, filed Aug. 3, 2016, which itself is related to U.S. Provisional Application Ser. No. 62/261,104, filed Nov. 30, 2015, and U.S. Provisional Application Ser. No. 62/111,927, filed Feb. 4, 2015.

This application is further related to U.S. application Ser. No. 15/014,236, filed Feb. 4, 2015. The entire disclosures of the aforementioned applications, and of all U.S. patents and published and applications referred to below, are also herein incorporated by reference.

BACKGROUND

This invention relates to methods for driving bistable electro-optic displays, and to apparatus for use in such methods. More specifically, this invention relates to driving methods and apparatus for adjusting the gate on voltage value after an active update to reduce transistor degradation associated with voltage stress that may be caused by remnant voltage discharging.

SUMMARY

According to one aspect of the subject matter disclosed herein, an apparatus for driving an electro-optic display may comprise a first switch designed to supply a voltage to the electro-optic display during a first driving phase, a second switch designed to control the voltage during a second driving phase, and a resistor coupled to the first and second switches for controlling the rate of decay of the voltage during the second driving phase. In some embodiments, during the first and second driving phases, only one of the first and second switches is engaged. In yet some other embodiments, both the first and second switches are disengaged during a third driving phase.

In another aspect of the subject matter disclosed herein, the invention includes an electro-optic display including an electrophoretic display medium electrically coupled between a common electrode and a display pixel electrode associated with a display pixel. The electro-optic display also includes a display controller circuit in electrical communication with the common electrode and an n-type transistor associated with the display pixel electrode. The display controller circuit is capable of applying waveforms including one or more frames to the display pixel by applying one or more voltages to the common electrode and to the display pixel electrode via the n-type transistor. The one or more voltages are sufficient to change an optical state of the electrophoretic display medium in proximity to the display pixel. The display controller circuit is configured to detect that the display pixel is in an idle state, apply a null transition waveform to the display pixel, and invoke automatically, in response to the null transition waveform, a first post-drive waveform sequence. The null transition waveform consists of a single frame.

In some embodiments, determining that the display pixel is in an idle state further includes determining a first period of time has elapsed since a driving waveform has been applied to the display pixel, and determining there are no pending requests to apply a driving waveform to the display pixel.

In some embodiments, the display controller circuit is further configured to receive a request to update the display pixel during the null transition waveform, complete the null transition waveform, bypass the post-drive waveform sequence, and apply a driving waveform to the display pixel according to the request.

In some embodiments, the display controller circuit is further configured to receive a request to update the display pixel during the first post-drive waveform sequence, interrupt the first post-drive waveform sequence, and apply a driving waveform to the display pixel according to the request.

In some embodiments, invoking the first post-drive waveform sequence includes applying substantially zero volts to the common electrode and the display pixel electrode, and applying a gate on voltage to a gate electrode of the n-type transistor. The gate on voltage is a positive voltage sufficient to create a conduction path through the n-type transistor for discharging a remnant charge from the electrophoretic display medium.

In some embodiments, invoking the first post-drive waveform sequence includes applying substantially zero volts to the common electrode and the display pixel electrode, and applying a gate off voltage to a gate electrode of the n-type transistor. The gate off voltage is a negative voltage sufficient to prevent formation of a conduction path through the n-type transistor. In some embodiments, the gate off voltage is configured to reduce a bias stress on the n-type transistor. In some embodiments, the gate off voltage is configured to shift a transconductance value of the n-type transistor.

In some embodiments, invoking the first post-drive waveform sequence further includes discharging a remnant charge from the electrophoretic display medium through a current leakage path within the n-type transistor.

In some embodiments, invoking the first post-drive waveform sequence consists of (i) applying substantially zero volts to the common electrode and the display pixel electrode, (ii) applying, for a first post-drive period of time, a gate on voltage to a gate electrode of the n-type transistor where the gate on voltage is a positive voltage sufficient to create a conduction path through the n-type transistor for discharging a remnant charge from the electrophoretic display medium, (iii) applying, for a second post-drive period of time, a gate off voltage to a gate electrode of the n-type transistor where the gate off voltage is a negative voltage sufficient to prevent formation of a conduction path through the n-type transistor, and (iv) returning the display pixel to the idle state.

In some embodiments, the null transition waveform has a duration of between 10 ms and 20 ms. In some embodiments, applying a null transition waveform to the display pixel includes applying a substantially equal voltage to the common electrode and the display pixel electrode, and applying a gate on voltage to a gate electrode of the n-type transistor, where the gate on voltage is a positive voltage sufficient to create a conduction path through the n-type transistor.

In another aspect of the subject matter disclosed herein, the invention includes a method for driving an electro-optic display that includes an electrophoretic display medium electrically coupled between a common electrode and a display pixel. The display pixel is associated with a display pixel electrode and an n-type transistor electrically coupled to a display controller circuit capable of applying waveforms comprising one or more frames to the display pixel by applying one or more voltages to the common electrode and to the display pixel electrode via the n-type transistor. The one or more voltages are sufficient to change an optical state of the electrophoretic display medium in proximity to the display pixel. The method includes the following steps in order: detecting the display pixel is in an idle state, applying a null transition waveform to the display pixel where the null transition waveform consisting of a single frame, and invoking automatically, in response to the null transition waveform, a first post-drive waveform sequence.

In some embodiments, determining the display pixel is in an idle state further includes determining a first period of time has elapsed since a driving waveform has been applied to the display pixel, and determining there are no pending requests to apply a driving waveform to the display pixel In some embodiments, the method further includes receiving a request to update the display pixel during the null transition waveform, completing the null transition waveform, bypassing the post-drive waveform sequence, and applying a driving waveform to the display pixel according to the request.

In some embodiments, the method further includes receiving a request to update the display pixel during the first post-drive waveform sequence, interrupting the first post-drive waveform sequence, and applying a driving waveform to the display pixel according to the request.

In some embodiments, invoking the first post-drive waveform sequence includes applying substantially zero volts to the common electrode and the display pixel electrode, and applying a gate on voltage to a gate electrode of the n-type transistor where the gate on voltage is a positive voltage sufficient to create a conduction path through the n-type transistor for discharging a remnant charge from the electrophoretic display medium.

In some embodiments, invoking the first post-drive waveform sequence includes applying substantially zero volts to the common electrode and the display pixel electrode, and applying a gate off voltage to a gate electrode of the n-type transistor, where the gate off voltage is a negative voltage sufficient to prevent formation of a conduction path through the n-type transistor.

In some embodiments, the gate off voltage is configured to reduce a bias stress on the n-type transistor. In some embodiments, the gate off voltage is configured to shift a transconductance value of the n-type transistor.

In some embodiments, invoking the first post-drive waveform sequence further includes discharging a remnant charge from the electrophoretic display medium through a current leakage path within the n-type transistor.

In some embodiments, invoking the first post-drive waveform sequence consists of: (i) applying substantially zero volts to the common electrode and the display pixel electrode, (ii) applying, for a first post-drive period of time, a gate on voltage to a gate electrode of the n-type transistor where the gate on voltage is a positive voltage sufficient to create a conduction path through the n-type transistor for discharging a remnant charge from the electrophoretic display medium, (iii) applying, for a second post-drive period of time, a gate off voltage to a gate electrode of the n-type transistor where the gate off voltage is a negative voltage sufficient to prevent formation of a conduction path through the n-type transistor, and (iv) returning the display pixel to the idle state.

In some embodiments, the null transition waveform has a duration of between 10 ms and 20 ms.

In some embodiments, applying a null transition waveform to the display pixel includes applying a substantially equal voltage to the common electrode and the display pixel electrode, and applying a gate on voltage to a gate electrode of the n-type transistor, where the gate on voltage is a positive voltage sufficient to create a conduction path through the n-type transistor.

BRIEF DESCRIPTION OF DRAWINGS

Various aspects and embodiments of the application will be described with reference to the following figures. It should be appreciated that the figures are not necessarily drawn to scale. Items appearing in multiple figures are indicated by the same reference number in all the figures in which they appear.

DETAILED DESCRIPTION

Terms

Figure 1A:
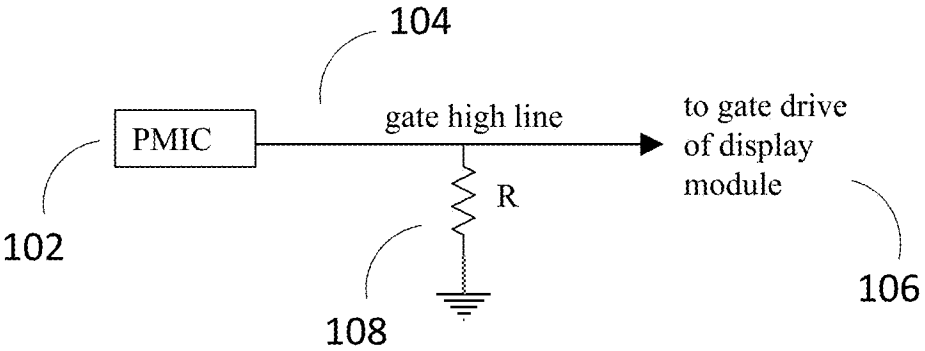
FIG. 1A is a schematic of a simple gate on voltage electrical circuit of an electro-optic display, according to some embodiments.

Electro-optic displays comprise a layer of electro-optic material, a term which is used herein in its conventional meaning in the imaging art to refer to a material having first and second display states differing in at least one optical property, the material being changed from its first to its second display state by application of an electric field to the material. In the displays of the present disclosure, the electro-optic medium may be a solid (such displays may hereinafter for convenience be referred to as "solid electro-optic displays"), in the sense that the electro-optic medium has solid external surfaces, although the medium may, and often does, have internal liquid- or gas-filled spaces. Thus, the term "solid electro-optic displays" includes encapsulated electrophoretic displays, encapsulated liquid crystal displays, and other types of displays discussed below.

Although the optical property may be color perceptible to the human eye, it may be another optical property, such as optical transmission, reflectance, luminescence, or, in the case of displays intended for machine reading, pseudo-color in the sense of a change in reflectance of electromagnetic wavelengths outside the visible range. The term L star may be used herein, and may be represented by "L*". L* has the usual CIE definition: $L^*=116(R/R0)1/3-16$, where R is the reflectance and R0 is a standard reflectance value.

The term "gray state" is used herein in its conventional meaning in the imaging art to refer to a state intermediate two extreme optical states of a pixel, and does not necessarily imply a black-white transition between these two extreme states. For example, several of the patents and published applications referred to below describe electrophoretic displays in which the extreme states are white and deep blue, so that an intermediate "gray state" would actually be pale blue. Indeed, as already mentioned the transition between the two extreme states may not be a color change at all.

The terms "bistable" and "bistability" are used herein in their conventional meaning in the art to refer to displays comprising display elements having first and second display states differing in at least one optical property, and such that after any given element has been driven, by means of an addressing pulse of finite duration, to assume either its first or second display state, after the addressing pulse has terminated, that state will persist for at least several times, for example at least four times, the minimum duration of the addressing pulse used to change the state of the display element. It is shown in published U.S. Patent Application No. 2002/0180687 that some particle-based electrophoretic displays capable of gray scale are stable not only in their extreme black and white states but also in their intermediate gray states, and the same is true of some other types of electro-optic displays. This type of display is properly called "multi-stable" rather than bistable, although for convenience the term "bistable" may be used herein to cover both bistable and multi-stable displays.

The term "remnant voltage" is used herein to refer to a persistent or decaying electric field that may remain in an electro-optic display after an addressing pulse (a voltage pulse used to change the optical state of the electro-optic medium) is terminated. The rate of decay of a remnant voltage of an electro-optic display may become low as the remnant voltage approaches a threshold value. Even low remnant voltages (e.g., remnant voltages of approximately 200 mV or less) can give rise to artifacts in electro-optic displays, including, without limitation, shift in the optical state associated with an addressing pulse, drift in the optical state of the display over time, and/or ghosting.

The persistence of the remnant voltage for a significant time period applies a "remnant impulse" to the electro-optic medium, and strictly speaking this remnant impulse, rather than the remnant voltage, may be responsible for the effects on the optical states of electro-optic displays normally considered as caused by remnant voltage. Such remnant voltages can lead to undesirable effects on the images displayed on electro-optic displays, including, without limitation, so-called "ghosting" phenomena, in which, after the display has been rewritten, traces of the previous image are still visible.

A "shift" in the optical state associated with an addressing pulse refers to a situation in which a first application of a particular addressing pulse to an electro-optic display results in a first optical state (e.g., a first gray tone), and a subsequent application of the same addressing pulse to the electro-optic display results in a second optical state (e.g., a second gray tone). Remnant voltages may give rise to shifts in optical state because the voltage applied to a pixel of the electro-optic display during application of an addressing pulse includes the sum of the remnant voltage and the voltage of the addressing pulse.

A "drift" in the optical state of a display over time refers to a situation in which the optical state of an electro-optic display changes while the display is at rest (e.g., during a period in which an addressing pulse is not applied to the display). Remnant voltages may give rise to drifts in optical state because the optical state of a pixel may depend on the pixel's remnant voltage, and a pixel's remnant voltage may decay over time.

As discussed above, "ghosting" refers to a situation in which, after the electro-optic display has been rewritten, traces of the previous image(s) are still visible. Remnant voltages may give rise to "edge ghosting," a type of ghosting in which an outline (edge) of a portion of a previous image remains visible.

The term "impulse" is used herein in its conventional meaning in the imaging art of the integral of voltage with respect to time. However, some bistable electro-optic media act as charge transducers, and with such media an alternative definition of impulse, namely the integral of current over time (which is equal to the total charge applied) may be used. The appropriate definition of impulse should be used, depending on whether the medium acts as a voltage-time impulse transducer or a charge impulse transducer.

Several types of electro-optic displays are known. One type of electro-optic display is a rotating bichromal member type as described, for example, in U.S. Pat. Nos. 5,808,783; 5,777,782; 5,760,761; 6,054,071 6,055,091; 6,097,531; 6,128,124; 6,137,467; and 6,147,791 (although this type of display is often referred to as a "rotating bichromal ball" display, the term "rotating bichromal member" is preferred as more accurate since in some of the patents mentioned above the rotating members are not spherical). Such a display uses a large number of small bodies (which may be, without limitation, spherical or cylindrical) which have two or more sections with differing optical characteristics, and an internal dipole. These bodies are suspended within liquid-filled vacuoles within a matrix, the vacuoles being filled with liquid so that the bodies are free to rotate. The appearance of the display is changed by applying an electric field thereto, thus rotating the bodies to various positions and varying which of the sections of the bodies is seen through a viewing surface. This type of electro-optic medium may be bistable.

Another type of electro-optic display uses an electrochromic medium, for example an electrochromic medium in the form of a nanochromic film comprising an electrode formed at least in part from a semi-conducting metal oxide and a plurality of dye molecules capable of reversible color change attached to the electrode; see, for example O'Regan, B., et al., Nature 1991, 353, 737; and Wood, D., Information Display, 18(3), 24 (March 2002). See also Bach, U., et al., Adv. Mater., 2002, 14(11), 845. Nanochromic films of this type are also described, for example, in U.S. Pat. No. 6,301,038, International Application Publication No. WO 01/27690, and in U.S. Patent Application 2003/0214695. This type of medium may be bistable.

Another type of electro-optic display is the particle-based electrophoretic display, in which a plurality of charged particles move through a suspending fluid under the influence of an electric field. Some attributes of electrophoretic displays are described in U.S. Pat. No. 6,531,997, titled "Methods for Addressing Electrophoretic Displays" and issued Mar. 11, 2003, which is hereby incorporated herein in its entirety.

Electrophoretic displays can have attributes of good brightness and contrast, wide viewing angles, state bistability, and low power consumption when compared with liquid crystal displays. Nevertheless, there may be problems with the long-term image quality of some particle-based electrophoretic displays. For example, particles that make up some electrophoretic displays may settle, resulting in inadequate service-life for such displays.

As noted above, electrophoretic media may include a suspending fluid. This suspending fluid may be a liquid, but electrophoretic media can be produced using gaseous suspending fluids; see, for example, Kitamura, T., et al., "Electrical toner movement for electronic paper-like display", IDW Japan, 2001, Paper HCS1-1, and Yamaguchi, Y., et al., "Toner display using insulative particles charged triboelectrically", IDW Japan, 2001, Paper AMD4-4). See also European Patent Applications 1,429,178; 1,462,847; and 1,482,354; and International Applications WO 2004/090626; WO 2004/079442; WO 2004/077140; WO 2004/059379; WO 2004/055586; WO 2004/008239; WO 2004/006006; WO 2004/001498; WO 03/091799; and WO 03/088495. Some gas-based electrophoretic media may be susceptible to the same types of problems as some liquid-based electrophoretic media due to particle settling, when the media are used in an orientation which permits such settling, for example in a sign where the medium is disposed in a vertical plane. Indeed, particle settling appears to be a more serious problem in some gas-based electrophoretic media than in some liquid-based ones, since the lower viscosity of gaseous suspending fluids as compared with liquid ones allows more rapid settling of the electrophoretic particles.

Numerous patents and applications assigned to or in the names of the Massachusetts Institute of Technology (MIT), E Ink Corporation, E Ink California, LLC, and related companies describe various technologies used in encapsulated and microcell electrophoretic and other electro-optic media. Encapsulated electrophoretic media comprise numerous small capsules, each of which itself comprises an internal phase containing electrophoretically-mobile particles in a fluid medium, and a capsule wall surrounding the internal phase. Typically, the capsules are themselves held within a polymeric binder to form a coherent layer positioned between two electrodes. In a microcell electrophoretic display, the charged particles and the fluid are not encapsulated within microcapsules but instead are retained within a plurality of cavities formed within a carrier medium, typically a polymeric film. The technologies described in these patents and applications include:

(a) Electrophoretic particles, fluids and fluid additives; see for example U.S. Pat. Nos. 7,002,728 and 7,679,814;

(b) Capsules, binders and encapsulation processes; see for example U.S. Pat. Nos. 6,922,276; 7,411,719;

(c) Microcell structures, wall materials, and methods of forming microcells; see for example U.S. Pat. No. 7,072,095 and U.S. Patent Applications Publication Nos. 2014/0065369;

(d) Methods for filling and sealing microcells; see for example U.S. Pat. No. 7,144,942 and U.S. Patent Applications Publication Nos. 2008/0007815;

(e) Films and sub-assemblies containing electro-optic materials; see for example U.S. Pat. Nos. 6,982,178; 7,839,564;

(f) Backplanes, adhesive layers and other auxiliary layers and methods used in displays; see for example U.S. Pat. Nos. 7,116,318 and 7,535,624;

(g) Color formation and color adjustment; see for example U.S. Pat. Nos. 7,075,502 and 7,839,564;

(h) Methods for driving displays; see for example U.S. Pat. Nos. 5,930,026; 6,445,489; 6,504,524; 6,512,354; 6,531,997; 6,753,999; 6,825,970; 6,900,851; 6,995,550; 7,012,600; 7,023,420; 7,034,783; 7,061,166; 7,061,662; 7,116,466; 7,119,772; 7,177,066; 7,193,625; 7,202,847; 7,242,514; 7,259,744; 7,304,787; 7,312,794; 7,327,511; 7,408,699; 7,453,445; 7,492,339; 7,528,822; 7,545,358; 7,583,251; 7,602,374; 7,612,760; 7,679,599; 7,679,813; 7,683,606; 7,688,297; 7,729,039; 7,733,311; 7,733,335; 7,787,169; 7,859,742; 7,952,557; 7,956,841; 7,982,479; 7,999,787; 8,077,141; 8,125,501; 8,139,050; 8,174,490; 8,243,013; 8,274,472; 8,289,250; 8,300,006; 8,305,341; 8,314,784; 8,373,649; 8,384,658; 8,456,414; 8,462,102; 8,537,105; 8,558,783; 8,558,785; 8,558,786; 8,558,855; 8,576,164; 8,576,259; 8,593,396; 8,605,032; 8,643,595;

8,665,206; 8,681,191; 8,730,153; 8,810,525; 8,928,562; 8,928,641; 8,976,444; 9,013,394; 9,019,197; 9,019,198; 9,019,318; 9,082,352; 9,171,508; 9,218,773; 9,224,338; 9,224,342; 9,224,344; 9,230,492; 9,251,736; 9,262,973; 9,269,311; 9,299,294; 9,373,289; 9,390,066; 9,390,661; 9,412,314; and 9,721,495; and U.S. Patent Applications Publication Nos. 2003/0102858; 2004/0246562; 2005/0253777; 2007/0070032; 2007/0076289; 2007/0091418; 2007/0103427; 2007/0176912; 2007/0296452; 2008/0024429; 2008/0024482; 2008/0136774; 2008/0169821; 2008/0218471; 2008/0291129; 2008/0303780; 2009/0174651; 2009/0195568; 2009/0322721; 2010/0194733; 2010/0194789; 2010/0220121; 2010/0265561; 2010/0283804; 2011/0063314; 2011/0175875; 2011/0193840; 2011/0193841; 2011/0199671; 2011/0221740; 2012/0001957; 2012/0098740; 2013/0063333; 2013/0194250; 2013/0249782; 2013/0321278; 2014/0009817; 2014/0085355; 2014/0204012; 2014/0218277; 2014/0240210; 2014/0253425; 2014/0292830; 2014/0293398; 2014/0333685; 2014/0340734; 2015/0070744; 2015/0097877; 2015/0109283; 2015/0213749; 2015/0213765; 2015/0221257; 2015/0262255; 2016/0071465; 2016/0078820; 2016/0093253; 2016/0140910; and 2016/0180777;

(i) Applications of displays; see for example U.S. Pat. Nos. 7,312,784 and 8,009,348; and 9,197,704; and (j) Non-electrophoretic displays, as described in U.S. Pat. No. 6,241,921 and U.S. Patent Applications Publication Nos. 2015/0277160; and U.S. Patent Application Publications Nos. 2015/0005720 and 2016/0012710.

Many of the aforementioned patents and applications recognize that the walls surrounding the discrete microcapsules in an encapsulated electrophoretic medium could be replaced by a continuous phase, thus producing a so-called polymer-dispersed electrophoretic display, in which the electrophoretic medium comprises a plurality of discrete droplets of an electrophoretic fluid and a continuous phase of a polymeric material, and that the discrete droplets of electrophoretic fluid within such a polymer-dispersed electrophoretic display may be regarded as capsules or microcapsules even though no discrete capsule membrane is associated with each individual droplet; see for example, the aforementioned 2002/0131147. Accordingly, for purposes of the present application, such polymer-dispersed electrophoretic media are regarded as sub-species of encapsulated electrophoretic media.

A related type of electrophoretic display is a so-called "microcell electrophoretic display." In a microcell electrophoretic display, the charged particles and the suspending fluid are not encapsulated within microcapsules but instead are retained within a plurality of cavities formed within a carrier medium, e.g., a polymeric film. See, for example, International Application Publication No. WO 02/01281, and published U.S. Application No. 2002/0075556, both assigned to Sipix Imaging, Inc.

Many of the aforementioned E Ink and MIT patents and applications also contemplate microcell electrophoretic displays and polymer-dispersed electrophoretic displays. The term "encapsulated electrophoretic displays" can refer to all such display types, which may also be described collectively as "microcavity electrophoretic displays" to generalize across the morphology of the walls.

Another type of electro-optic display is an electro-wetting display developed by Philips and described in Hayes, R. A., et al., "Video-Speed Electronic Paper Based on Electrowetting," Nature, 425, 383-385 (2003). It is shown in copending application Ser. No. 10/711,802, filed Oct. 6, 2004, that such electro-wetting displays can be made bistable.

Other types of electro-optic materials may also be used. Of particular interest, bistable ferroelectric liquid crystal displays (FLCs) are known in the art and have exhibited remnant voltage behavior.

Although electrophoretic media may be opaque (since, for example, in many electrophoretic media, the particles substantially block transmission of visible light through the display) and operate in a reflective mode, some electrophoretic displays can be made to operate in a so-called "shutter mode" in which one display state is substantially opaque and one is light-transmissive. See, for example, the patents U.S. Pat. Nos. 6,130,774 and 6,172,798, and 5,872,552; 6,144,361; 6,271,823; 6,225,971; and 6,184,856. Dielectrophoretic displays, which are similar to electrophoretic displays but rely upon variations in electric field strength, can operate in a similar mode; see U.S. Pat. No. 4,418,346. Other types of electro-optic displays may also be capable of operating in shutter mode.

An encapsulated or microcell electrophoretic display may not suffer from the clustering and settling failure mode of traditional electrophoretic devices and may provide further advantages, such as the ability to print or coat the display on a wide variety of flexible and rigid substrates. (Use of the word "printing" is intended to include all forms of printing and coating, including, but without limitation: pre-metered coatings such as patch die coating, slot or extrusion coating, slide or cascade coating, curtain coating; roll coating such as knife over roll coating, forward and reverse roll coating; gravure coating; dip coating; spray coating; meniscus coating; spin coating; brush coating; air knife coating; silk screen printing processes; electrostatic printing processes; thermal printing processes; inkjet printing processes; electrophoretic deposition; and other similar techniques.) Thus, the resulting display can be flexible. Further, because the display medium can be printed (using a variety of methods), the display itself can be made inexpensively.

The bistable or multi-stable behavior of particle-based electrophoretic displays, and other electro-optic displays displaying similar behavior (such displays may hereinafter for convenience be referred to as "impulse driven displays"), is in marked contrast to that of liquid crystal displays ("LCDs"). Twisted nematic liquid crystals are not bi- or multi-stable but act as voltage transducers, so that applying a given electric field to a pixel of such a display produces a specific gray level at the pixel, regardless of the gray level previously present at the pixel. Furthermore, LC displays are only driven in one direction (from non-transmissive or "dark" to transmissive or "light"), the reverse transition from a lighter state to a darker one being effected by reducing or eliminating the electric field. Also, the gray level of a pixel of an LC display is not sensitive to the polarity of the electric field, only to its magnitude, and indeed for technical reasons commercial LC displays usually reverse the polarity of the driving field at frequent intervals. In contrast, bistable electro-optic displays act, to a first approximation, as impulse transducers, so that the final state of a pixel depends not only upon the electric field applied and the time for which this field is applied, but also upon the state of the pixel prior to the application of the electric field.

A high-resolution display may include individual pixels which are addressable without interference from adjacent pixels. One way to obtain such pixels is to provide an array of non-linear elements, such as transistors or diodes, with at least one non-linear element associated with each pixel, to produce an "active matrix" display. An addressing or pixel electrode, which addresses one pixel, is connected to an appropriate voltage source through the associated non-linear element. When the non-linear element is a transistor, the pixel electrode may be connected to the drain of the transistor, and this arrangement will be assumed in the following description, although it is essentially arbitrary and the pixel electrode could be connected to the source of the transistor. In high resolution arrays, the pixels may be arranged in a two-dimensional array of rows and columns, such that any specific pixel is uniquely defined by the intersection of one specified row and one specified column. The sources of all the transistors in each column may be connected to a single column electrode, while the gates of all the transistors in each row may be connected to a single row electrode; again the assignment of sources to rows and gates to columns may be reversed if desired.

The display may be written in a row-by-row manner. The row electrodes are connected to a row driver, which may apply to a selected row electrode a voltage such as to ensure that all the transistors in the selected row are conductive, while applying to all other rows a voltage such as to ensure that all the transistors in these non-selected rows remain non-conductive. The column electrodes are connected to column drivers, which place upon the various column electrodes voltages selected to drive the pixels in a selected row to their desired optical states. (The aforementioned voltages are relative to a common front electrode which may be provided on the opposed side of the electro-optic medium from the non-linear array and extends across the whole display.) After a pre-selected interval known as the "line address time," a selected row is deselected, another row is selected, and the voltages on the column drivers are changed so that the next line of the display is written.

Remnant Voltage Discharging

As described in U.S. Provisional Application 62/111,927, filed Feb. 4, 2015, the entire contents are herein incorporated by reference, a preferred embodiment for dissipating remnant voltage brings all pixel transistors into conduction for an extended time. For example, all pixel transistors may be brought into conduction by bringing gate line (as referred to herein as "select line") voltage relative to the source line voltages to values that bring pixel transistors to a state where they are relatively conductive compared to the non-conductive state used to isolate pixels from source lines as part of normal active-matrix drive.

In some embodiments, a specially designed circuitry may provide for addressing all pixels at the same time. In a standard active-matrix operation, select line control circuitry typically does not bring all gate lines to values that achieve the above-mentioned conduction state for all pixel transistors. A convenient way to achieve this condition is afforded by select line driver chips that have an input control line that allows an external signal to impose a condition where all select line outputs receive a voltage supplied to the select driver chosen to bring pixel transistors into conduction. By applying the appropriate voltage value to this special input control line, all transistors may be brought into conduction. By way of example, for displays that have n-type pixel transistors, some select drivers have a "Xon" control line input. By choosing a voltage value to input to the Xon pin input to the select drivers, the gate on voltage is routed to all the select lines. For simplicity the description of this invention is written for backplane that employs n-type pixel transistors. In this case the gate on voltage is positive. However for backplane made with p-type pixel transistors, all the methods described here can be employed by inverting all the voltages described and shown in this invention. In this case the gate on voltage would be negative.

The gate on voltage is an important voltage for the purpose of dissipating remnant voltage of an electro-optic active matrix display. Application of the gate on voltage across the entire display is integral to the "post-drive discharge" which is typically applied at the end of the "active drive phase" (also referred to herein as "image update" or "active update period"). The "post-drive discharge phase" (also referred to herein as "remnant voltage discharge phase" or "remnant voltage discharging") is part of the "voltage decay phase" and, if the post-drive discharge phase is equal to the voltage decay phase, these terms may be used interchangeably (and herein are used interchangeably).

However, as described in U.S. Provisional Application 62/219,606 filed Sep. 16, 2015, the entire contents are herein incorporated by reference, holding the pixel transistors on a conducting state for extended duration needed for remnant voltage discharging may cause pixel transistor degradation and/or a shift in optical performance of a display. It is advantageous to be able to adjust the gate on voltage value during the post-drive discharge phase to reduce and/or prevent the effects of holding the pixel transistors for an extended duration. Post-drive discharging may be performed after every active update, after a specified number of active updates, after a specified period of time or when requested by a user. Further, post-drive discharging may be interrupted by an active update such that the gate on voltage value may not reach a zero value.

The present invention describes apparatuses and methods for adjusting the gate on voltage value after the active update phase.

E/O Electronics

As described above, extended periods of high gate voltage values, such as those experienced during remnant voltage discharging, may cause pixel transistor degradation. Reducing the high gate voltage value during remnant voltage discharging and/or speeding up the decay rate for dissipating remnant voltage may diminish or prevent pixel transistor degradation. The optimal decay rate for dissipating remnant voltage in a display may be determined empirically by balancing the acceptable level of discharging efficacy and the impact on the pixel transistor's transconductance. One advantage of this invention is that the post-drive discharge may be achieved at a lower voltage which will reduce pixel transistor degradation and prevent optical shifting.

The various aspects described above, as well as further aspects, will now be described in detail below. It should be appreciated that these aspects may be used alone, all together, or in any combination of two or more, to the extent that they are not mutually exclusive.

Electro-optic displays may receive power from external electronics, such as a display controller and supply voltages from "power management" circuitry. The power management circuitry may supply multiple voltages, including "gate on voltage" supplied to gate lines (also referred to herein as "select lines") to bring transistors on selected lines into conduction. The power management circuitry may be discrete components or an integrated circuit (e.g., Power Management Integrated Circuit ("PMIC")). Additional circuitry may include pulldown resistor(s) and/or pulldown capacitor(s).

FIG. 1A is a schematic of a simple gate on voltage electrical circuit of an electro-optic display using a PMIC 102 that shows the gate on voltage line 104 from the PMIC 102 to the gate driver 106 of the active matrix display. The circuitry of FIG. 1 allows for controlling the gate on voltage 104 at the end of an active drive by changing the value of the pull down resistor R 108. A high value for R 108 would slow the gate on voltage decay rate while a low value of R 108 would speed up the gate on voltage decay rate. Assuming some level of capacitive element ("C") on the line 104 (not shown) from the PMIC to the gate driver, the pulldown resistor ("R") 108 will cause the gate on line 104 to decay exponentially to zero volts with a time constant given by the resistor value ("R") times the line capacitance ("C"). The voltage decay through the R resistor 108 may be calculated as follows:

$$V(t)=V_o e^{-t/RC}$$

where $V_o$ is the initial voltage and where the line capacitance C includes the parasitic capacitance of the voltage line and any capacitance that designed as part of the PMIC to stabilize the voltage.

The post-drive discharge method described in U.S. Provisional Application 62/111,927, cited above, takes advantage of the slow decay in the gate on voltage. During the post-drive discharge phase, which usually occurs after the active update phase, the gate on voltage is allowed to decay typically through resistors connected to ground. In post-drive discharge, all active-matrix select lines are brought to the gate on voltage, which decay to ground from its value during active display driving.

Figure 1B:
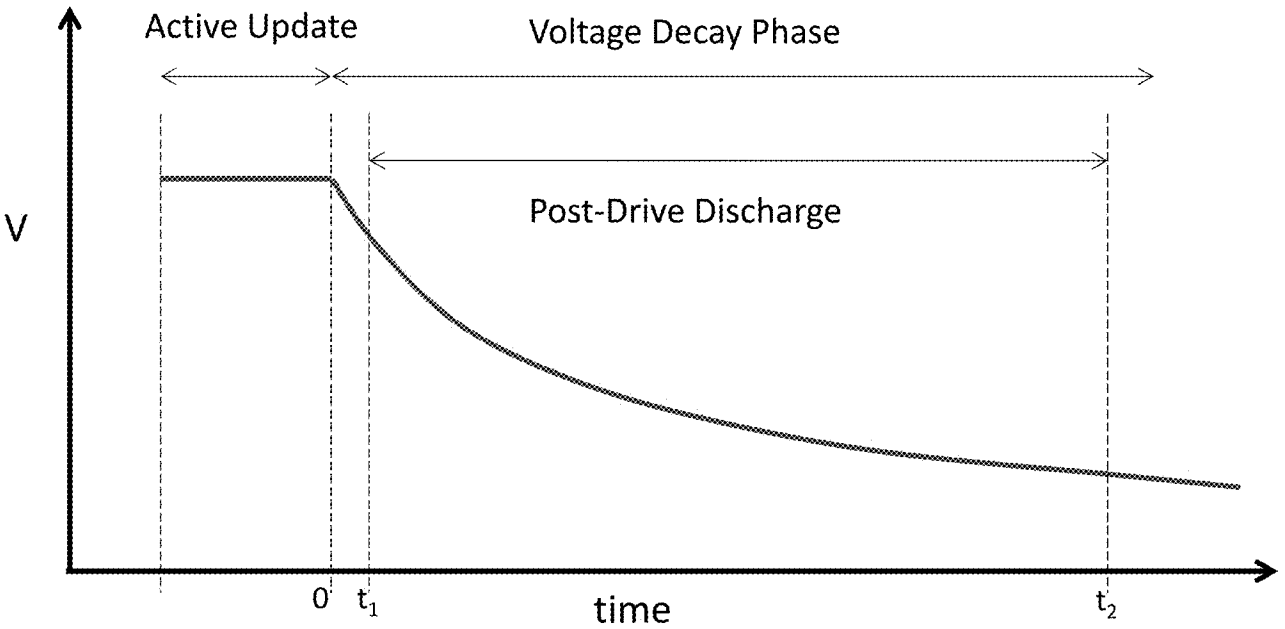
FIG. 1B is a graph showing gate on voltage versus time during an active update and a voltage decay phase, which includes a post-drive discharge phase, where the gate on voltage decays exponential to ground, according to some embodiments.

FIG. 1B is a graph showing gate on voltage versus time during an active update and a voltage decay phase, which includes a post-drive discharge phase, where the gate on voltage decays exponentially to ground. Time t=0 is at the end of the active update. In FIG. 1B, a "post-drive discharge" period is defined as starting at a time $t_1$ and ending at a time $t_2$. The time $t_1$ may be as small as zero, in which case the post-drive discharge begins immediately after the update, or may be delayed until the gate on voltage value decays or decreases to a preferred value. The time $t_2$ is chosen to be large enough that the post-drive discharge is effective in sufficiently reducing charge polarization in the display or, if time allows, until the gate on voltage decays to zero volts.

As described above, it is advantageous to apply a "gate on" voltage that is of sufficient magnitude to enable draining of pixel remnant voltage and not higher, so as to reduce transistor degradation. Higher than necessary voltage magnitudes increase TFT bias stress and are unlikely to improve remnant voltage draining. As shown in FIG. 1B, the simplest implementation of post-drive discharge is to allow the "gate on" voltage to decay exponentially during the post-drive discharge. The higher, initial voltage values are sufficient for the timely draining of remnant voltage, even if, the lower, later voltage values may be too small to enable timely draining of remnant voltage. Further, it advantageous to minimize the time that all select lines are turned on to enable sufficient remnant voltage discharging, but no longer than that.

This invention controls the "gate on" voltage to achieve these advantages by shaping the time profile of the "gate on" voltage during the post-drive discharge phase. The invention makes use of a metric, K, which is useful for assessing the advantageous nature of the "gate on" voltage profile during the post-drive discharge phase:

$$K = \frac{T_m}{T_h}$$

Where $T_m$ is the total time that the "gate on" voltage lies between a low voltage magnitude ($V_L$) and a high voltage magnitude ($V_H$) within a time domain starting at the end of a display update and up to a time $t_2$ after the end of the update, and $T_h$ is the total time that the "gate on" voltage is greater than $V_H$. $t_2$ is the time of the end of post-drive discharge when it is not interrupted by other display processes such as a next image update. The values $V_L$ and $V_H$ may be later defined or bounded based upon display performance and usage. Assigning values for $V_L$ and $V_H$ is described in more detail below. The voltages are defined relative to another voltage and are all relative to the "zero voltage" or "ground" for the driving electronics (source and/or select drivers and display controller).

Natural K ("$K_{natural}$") may be define as:

$$K_{natural} = \frac{\ln(V_H / V_L)}{\ln(V_0 / V_H)}$$

where $V_0$ is the "gate on" voltage applied during an image update or active update (as described above, all voltages are defined relative to the "gate off" voltage for the display under consideration). For convenience, we define a normalized K referred to here as a:

$$\alpha = \frac{K}{K_{natural}}$$

where K, $K_{natural}$ and alpha ("α") are all functions of the time $t_2$ and voltage parameters $V_L$ and $V_H$. A preferred voltage profile has alpha greater than 2, alpha greater than 5 or, preferably, alpha greater than 20, and where the values of $V_L$ and $V_H$ meet at least 2 of the following constraints: 1) $V_L$ is at least 5% of $V_0$; 2) $V_H$ is at less than 80% of $V_0$; 3) $V_H$ is greater than $V_L$; and 4) $(V_H-V_L)/[(V_H+V_L)/2]>0.1$. The fourth constraint may be met to assure that the separation between $V_H$ and $V_L$ is significant compared to the average of $V_H$ and $V_L$.

Figure 1C:
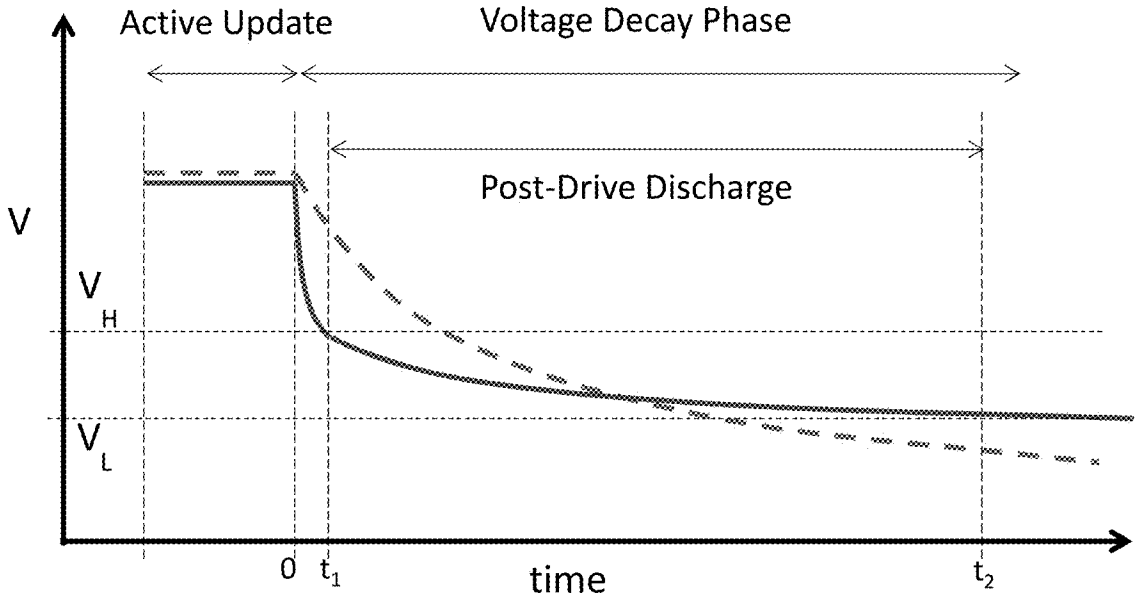
FIG. 1C is a graph showing gate on voltage versus time during an active update and a voltage decay phase having a preferred voltage profile, according to some embodiments.

FIG. 1C is a graph showing gate on voltage versus time during an active update and a voltage decay phase having a preferred voltage profile. The dashed line, previously depicted and described in FIG. 1B, shows a typical exponential decay after an active update. The solid line shows an example of a more advantageous voltage profile of a post-drive discharge phase where the gate on voltage value rapidly decays or is reduced to a lower value, then decays from this reduced value over time of post-drive discharge. As shown in FIG. 1C, the initial rapid reduction of the gate on value after the active update is completed prior to "turning on" all the select lines. Alternatively, all select lines may be turned on at t=0. In another alternative, all select lines may be turned on after the gate on voltage value is initially reduced and has decayed to a desired value or after a predetermined time. All select lines may be turned off ($t_2$) after post-drive discharge is effective in sufficiently reducing charge polarization in the display or, alternatively, after the gate on voltage decays to zero volts.

Figure 2A:
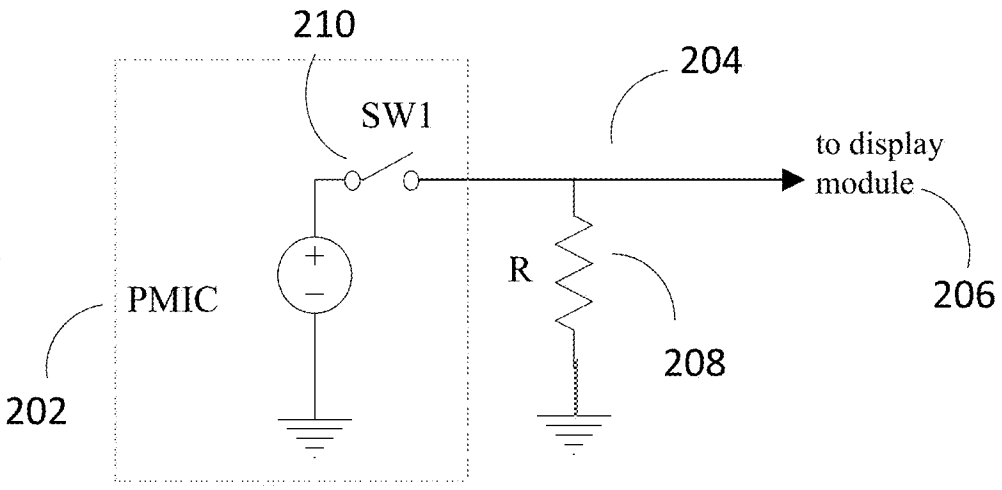
FIG. 2A is a schematic of a gate on voltage electrical circuit, including a resistor, of an electro-optic display, according to some embodiments.

FIG. 2A is a schematic of the simple electrical circuit layout of FIG. 1A further comprising a "single pole, single throw" switch ("SW1") 210 (which, as shown, is "open") between the PMIC 202 and the gate driver 206. When the SW1 switch 210 is closed, the circuit actively drives the gate driver 206. When the SW1 switch 210 is opened (at the end of the active drive), the PMIC 202 will cease to drive the gate high voltage 206 and the gate on voltage decay rate will be determined by the pulldown resistor R 208 and the various capacitances experienced by the gate on line 204.

Figure 2B:
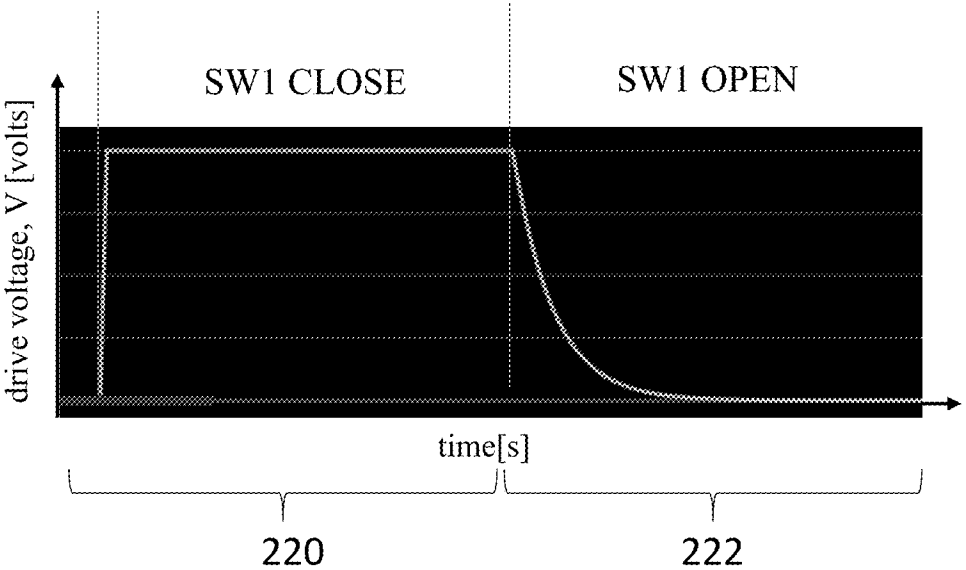
FIG. 2B is a graphical schematic depicting the gate on voltage over time for the circuit of FIG. 2A, according to some embodiments.

FIG. 2B is a graphical schematic depicting the gate on voltage over time of the circuit of FIG. 2A during the active drive phase 220 when the SW1 switch is closed and the voltage decay phase 222 when the SW1 switch is open.

Figure 3A:
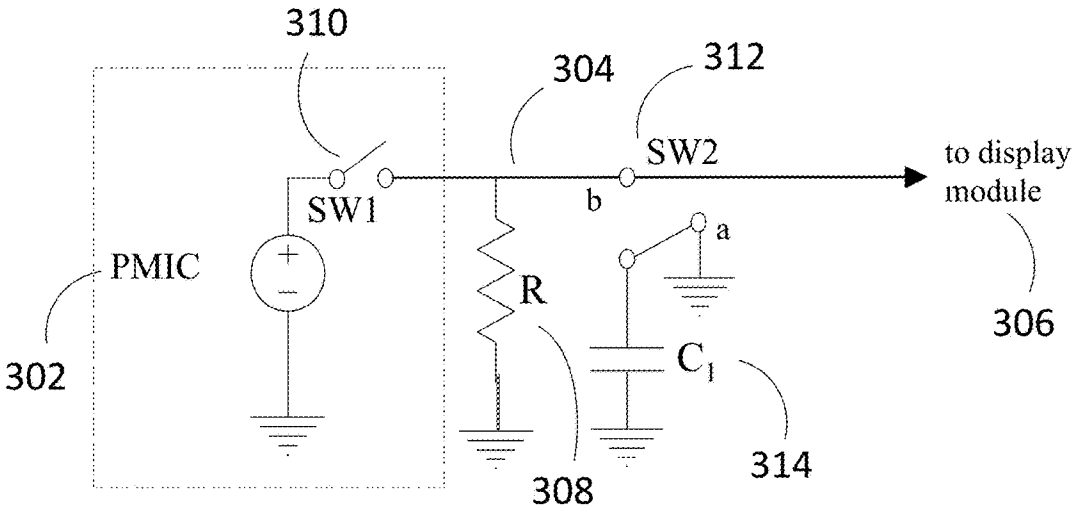
FIG. 3A is a schematic of a gate on voltage electrical circuit, including a resistor and a capacitor, of an electro-optic display, according to some embodiments.

FIG. 3A is a schematic of a gate on voltage electrical circuit according to an embodiment of the present invention. FIG. 3A shows the gate on voltage line 304 with a first "single pole, single throw" switch ("SW1") 310 from the PMIC 302 to the gate driver 306 of the active matrix display. The circuitry further comprises a resistor R 308, a second "single pole, double throw" switch ("SW2") 312 (which, as shown, is at position "a") and a pulldown capacitor ("$C_1$") 314.

The switches SW1 and SW2 are programmed to open and close approximately simultaneously, such that only one switch will be engaged at a time. In operation, SW1 closes and SW2 opens during active display driving while SW1 opens and SW2 closes during voltage decay phase and post-drive discharging. SW1 is an example of a single pole, single throw switch where it is only connected when the closed position. SW2 is an example of a single pole, double throw switch where it switches between two points such that it is always connected to either position "a" or position "b".

By incorporating a pulldown capacitor $C_1$ 314 and a second switch SW2 312, the gate on voltage value may be reduced to a lower value and, then, may decay from this reduced voltage value. At the end of the active drive, SW1 is open and SW2 is at position "b", the drive voltage ("V") decay may be calculated according to the following equation:

$$V = V_o\left(\frac{C}{C + C_1}\right)e^{-\frac{t}{R(C+C_1)}}$$

where C is the line capacitance of the gate on line 304 and $V_0$ is the initial voltage.

Figure 3B:
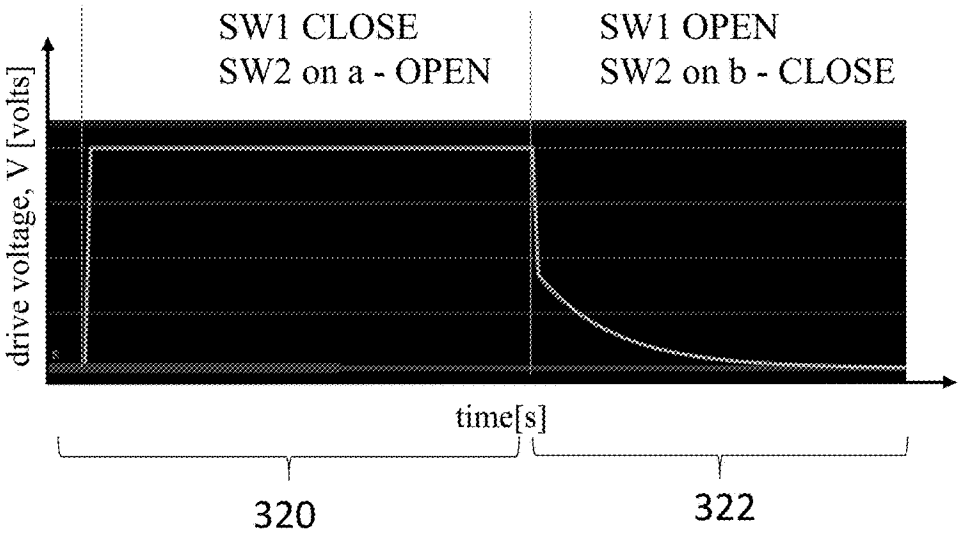
FIG. 3B is a graphical schematic depicting the gate on voltage over time for the circuit of FIG. 3A, according to some embodiments.

FIG. 3B is a graphical schematic depicting the gate on voltage over time for the circuit of FIG. 3A during the active drive phase 320, when the SW1 switch is closed and the SW2 switch is in position "a", and the voltage decay phase 322, when the SW1 switch is open and the SW2 switch is connected to position "b". As shown in FIG. 3B, during the active drive phase 320 (when SW1 is closed and SW2 is in position "a"), the PMIC drives the gate driver 306. During the voltage decay phase (when SW1 is open and SW2 is in position "b"), the voltage value is pulled quickly to a smaller voltage value (i.e., $V_oC/(C+C_1)$) and decays from this smaller value 322 at a rate determined by pulldown resistor R 308 and capacitance of C and $C_1$.

Figure 4A:
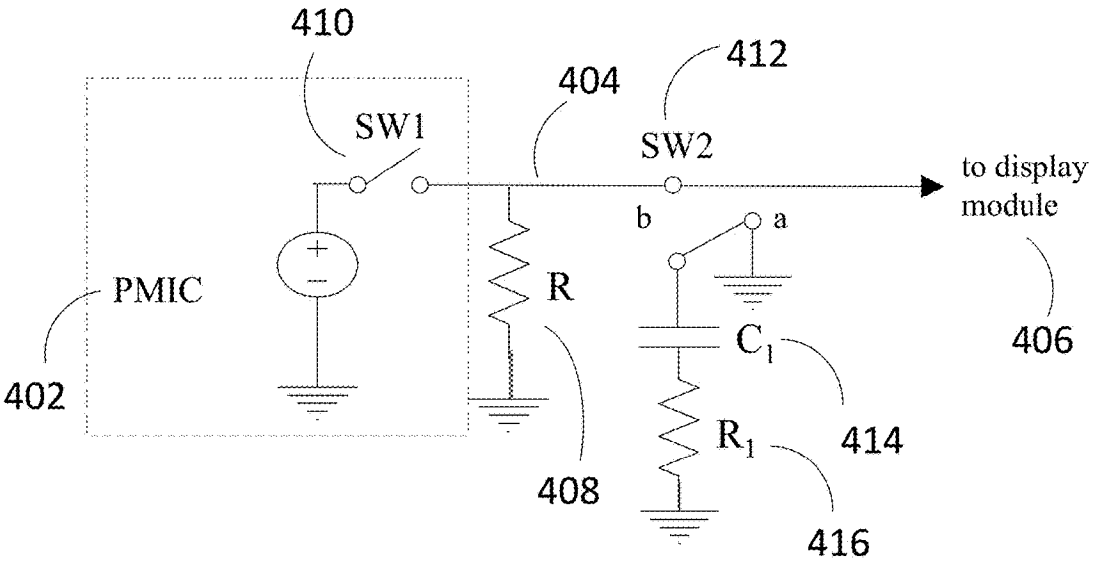
FIG. 4A is a schematic of a gate on voltage electrical circuit, including resistors and capacitors, of an electro-optic display, according to some embodiments.

FIG. 4A is a schematic of a gate on voltage electrical circuit according to another embodiment of the present invention. FIG. 4A shows the gate on voltage line 404 with a first switch ("SW1") 410 from the PMIC 402 to the gate driver 406 of the active matrix display. The circuitry further comprises a resistor R 408, a second switch ("SW2") 412 (which, as shown, is in position "a"), a pulldown capacitor ("$C_1$") 414 and a second pulldown resistor ("$R_1$") 416. The pulldown capacitor $C_1$ 414 and pulldown resistor $R_1$ 416 are in series with SW2 412; however, their positions in relation to SW2 may be swapped.

Figure 4B:
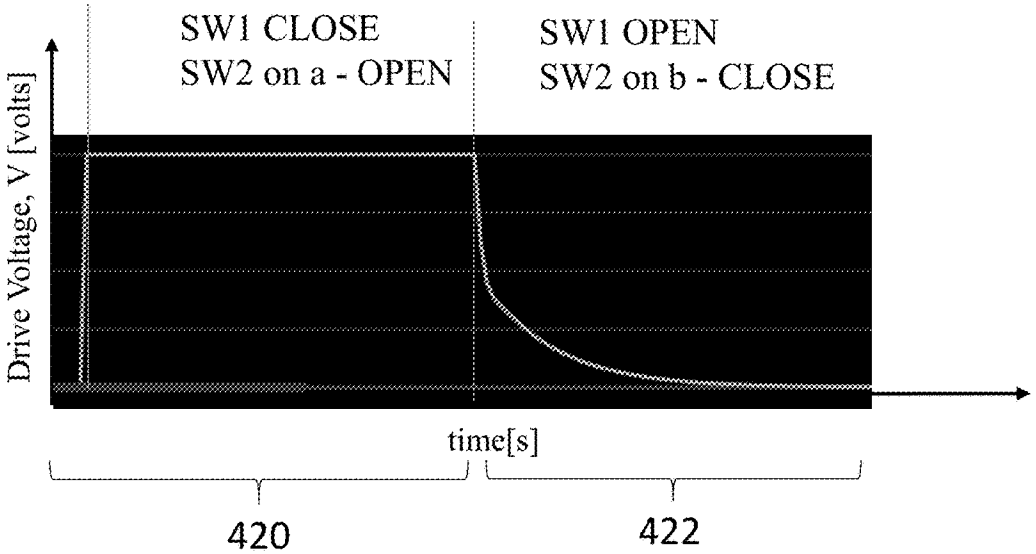
FIG. 4B is a graphical schematic depicting the gate on voltage over time for the circuit of FIG. 4A, according to some embodiments.

As shown in FIG. 4B, during the active drive phase 420 (when SW1 is closed and SW2 is in position "a"), the PMIC drives the gate driver 406 at the active drive gate on voltage value and charges capacitor $C_1$ 414. During the voltage decay phase 422 (when SW1 is open and SW2 is in position "b"), the gate on voltage value is reduced to the value of capacitor $C_1$ 414 and decays at rate determined by resistors R 408 and $R_1$ 416. The addition of the capacitor $C_1$ and resistors R and $R_1$ allows for a greater degree of control over the initial reduction and the decay rate of the gate on voltage value.

Figure 5A:
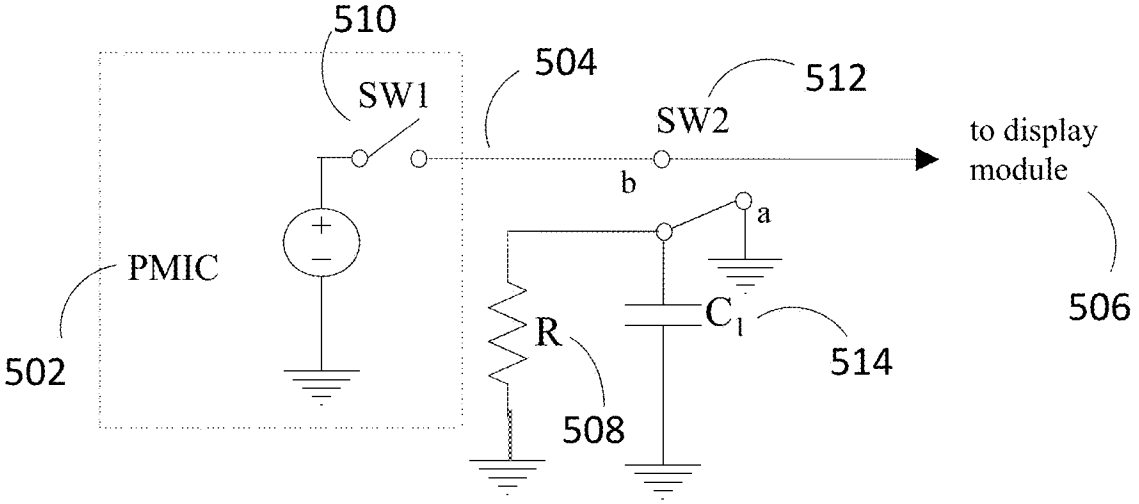
FIG. 5A is a schematic of a gate on voltage electrical circuit, including a resistor and a capacitor, of an electro-optic display, according to some embodiments.

FIG. 5A is a schematic of a gate on voltage electrical circuit according to another embodiment of the present invention that is equivalent to FIG. 3A. FIG. 5A shows the gate on voltage line 504 with a first switch ("SW1") 510 from the PMIC 502 to the gate driver 506 of the active matrix display. The circuitry further comprises a second single pole, double throw switch ("SW2") 512 (which, as shown, is in position "a") positioned on the gate on voltage line 504. SW2 512 engages a pulldown resistor R 508 and a pulldown capacitor $C_1$ 514. During the active drive phase (as depicted in FIG. 3B 320), when SW1 is closed and SW2 is in position "a", capacitor $C_1$ 514 will be charged. During the voltage decay phase (as depicted in FIG. 3B 322), when SW1 is open and SW2 is in position "b", the voltage value will initially drop to the value of capacitor $C_1$ 514, then decay at a rate determined by resistor R 508.

Using FIG. 5A as an example electrophoretic display, during an active update phase, the PMIC may drive the gate on voltage at +22 volts. During the post-drive discharge phase ("remnant voltage discharge"), a gate on voltage value of +22 volts is excessive and a reduced gate high voltage value is preferred. In some displays, remnant voltage discharge may be achieved by using a voltage value of about +8 volts. A preferred circuit of FIG. 5A includes a capacitor $C_1$ sufficient to bring the gate on voltage down quickly to about 10 to 12 volts after the active drive phase. The preferred capacitor $C_1$ value is about equal to the capacitance of the gate on line when it is attached to the display (SW2 is in position "b") but the PMIC is disconnected (SW1 is in position "b"). Because different displays and drive electronics have various gate on capacitances, a single capacitance value $C_1$ will not apply to all displays, but may be selected based on the desired initial voltage drop. Similarly with resistor R 508, a single resistor value will not apply to all displays, but may be selected based on the desired voltage decay rate.

Figure 5B:
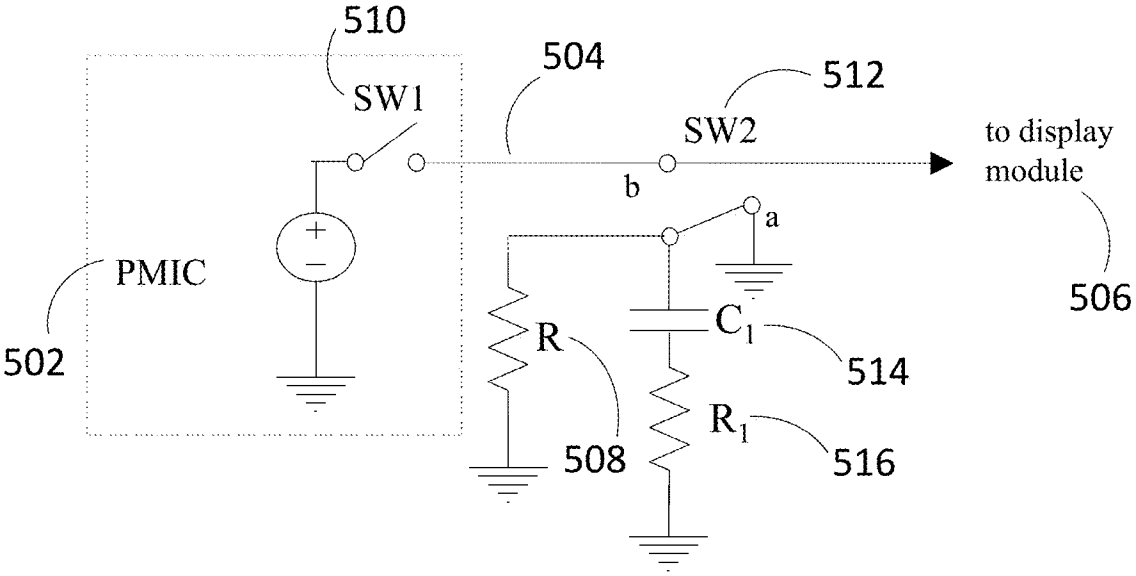
FIG. 5B is a schematic of a gate on voltage electrical circuit, including resistors and capacitors, of an electro-optic display, according to some embodiments.

FIG. 5B is a schematic of a gate on voltage electrical circuit according to another embodiment of the present invention that is equivalent to FIG. 4A. FIG. 5B is a schematic of the electrical circuitry of FIG. 5A further comprising a pulldown resistor $R_1$ 516. In FIG. 5B, SW2 512 engages a pulldown resistor R 508, pulldown capacitor $C_1$ 514 and pulldown resistor $R_1$ 516. During the active drive phase (as depicted in FIG. 4B 420), when SW1 is closed and SW2 is in position "a", capacitor $C_1$ 514 will discharge to 0V. During the voltage decay phase (as depicted in FIG. 4B 422), when SW1 is open and SW2 is in position "b", the voltage value will initially drop to the value of capacitor $C_1$ 514, then decay at a rate determined by R 508 and $R_1$ 516.

Figure 6A:
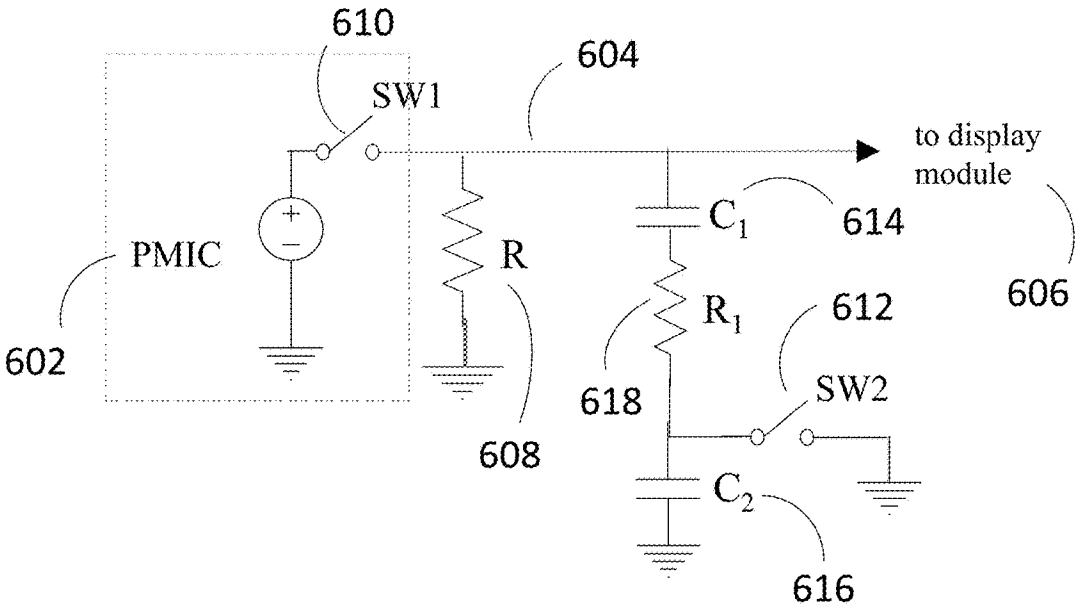
FIG. 6A is a schematic of a gate on voltage electrical circuit, including multiple capacitors and resistors, of an electro-optic display, according to some embodiments.

FIG. 6A is a schematic of a gate on voltage electrical circuit according to another embodiment of the present invention. FIG. 6A shows the gate on voltage line 604 with a first switch ("SW1") 610 from the PMIC 602 to the gate driver 606 of the active matrix display. The circuitry further comprises a pulldown resistor R 608, a pulldown capacitor ("$C_1$") 614, a second pulldown resistor ("$R_1$") 618, a second pulldown capacitor ("$C_2$") 616, and a second switch ("SW2") 612 (which, as shown, is "open") positioned between the resistor $R_1$ 618 and the pulldown capacitor $C_2$ 616. The pulldown capacitor $C_1$ 614, the pulldown resistor $R_1$ 618 and the pulldown capacitor $C_2$ 616 are in series.

When the PMIC brings the gate on line to $V_o$ volts by closing SW1 and opening SW2, the voltage across $C_1$ rises to $V_o*C_2/(C_1+C_2)$. The capacitors $C_1$ and $C_2$ are chosen to set this voltage to the low level desired during the post-drive discharge period. The resistor $R_1$ 618 is chosen to avoid current spikes that cannot be supported by the PMIC and the value of $R_1$ could be 0 ohms, in which case $R_1$ is not essential. It is also noted here that the position of $R_1$ 618 and $C_1$ 614 could be swapped. Then during the post-drive discharge period, SW1 is opened and SW2 closed so that the gate line is now held at the lower voltage, which slowly decays through the discharge through the combined resistance of resistor R 608 and $R_1$ 618. The advantages of this alternative embodiment compared to previous embodiment are 1) that the switch SW2 is a "single pole, single throw" which can be easily implemented with a transistor, and 2) the desired low voltage can be more easily set approximately independent of the gate line capacitance by choosing $C_1$ and $C_2$ values that are much larger than the other capacitances experienced by the gate line 604.

Figure 6B:
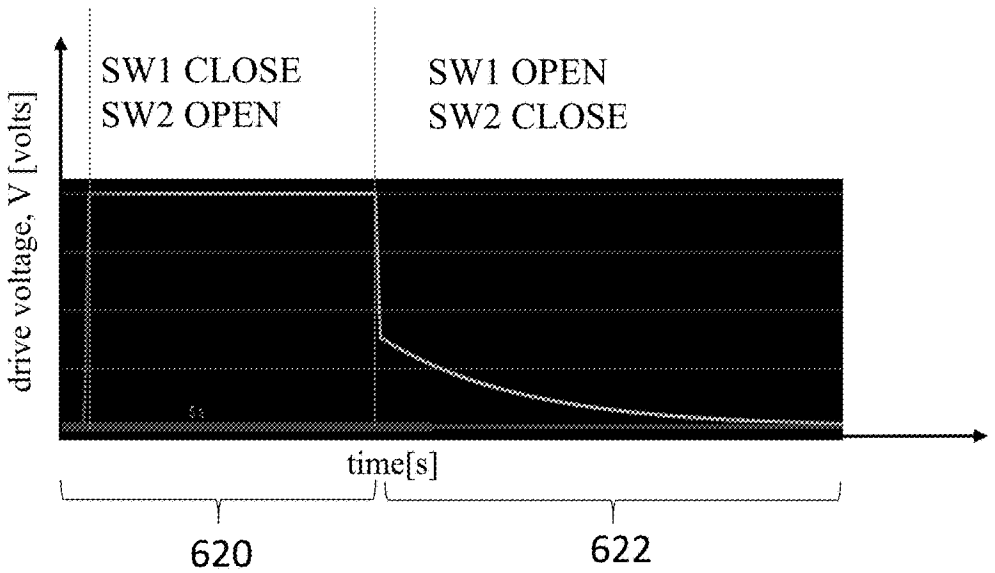
FIG. 6B is a graphical schematic depicting the gate on voltage over time for the circuit of FIG. 6A, according to some embodiments.

As shown in FIG. 6B, during the active drive phase 620 (when SW1 is closed and SW2 is open), the PMIC drives the gate driver 606 at the gate on voltage value for the active driving and charges capacitors $C_1$ and $C_2$, to voltage values that sum up to the "gate on" voltage value. During the voltage decay phase 622 (when SW1 is open and SW2 is closed), the gate on voltage value drops to the level of the voltage that was across $C_1$ during the active drive and then decays from this lower value. The addition of capacitors $C_1$ and $C_2$ and resistors R and $R_1$ allow for a greater degree of control over the initial reduction in the gate on voltage value, both in time and amount of reduction, and the rate of decay after the initial drop in value. These values may be set to optimize the reduction in voltage value during the voltage decay phase, or one or both of these resistors could be removed from the electrical circuit.

Figure 7:
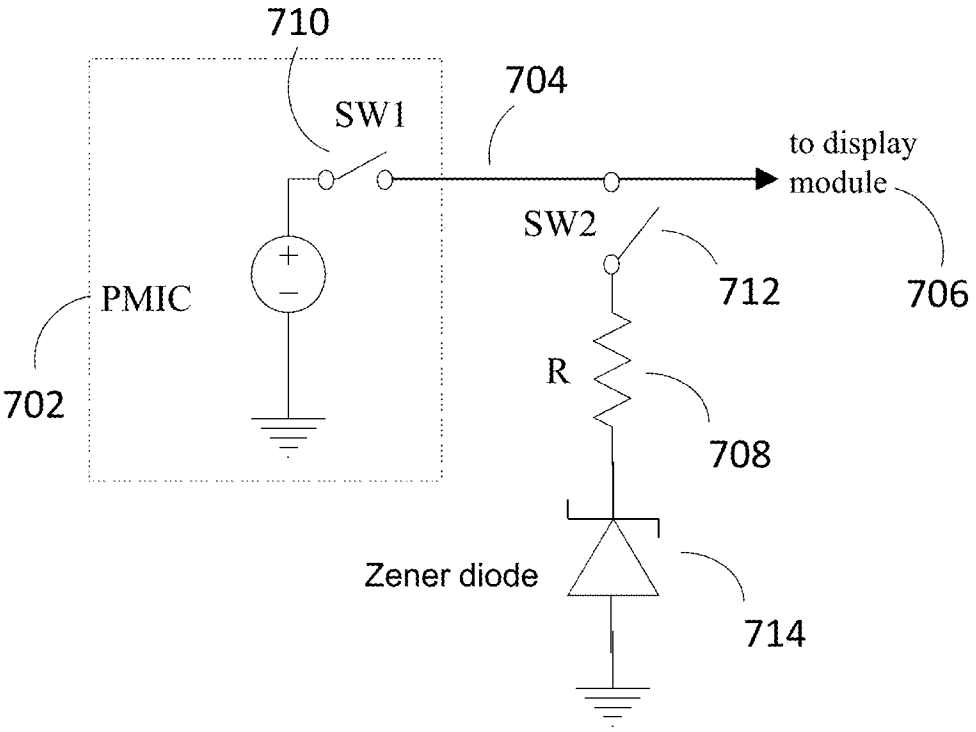
FIG. 7 is a schematic of a gate on voltage electrical circuit, including a Zener diode, of an electro-optic display, according to some embodiments.

FIG. 7 is a schematic of a gate on voltage electrical circuit according to another embodiment of the present invention. FIG. 7 shows the gate on voltage line 704 with a first switch ("SW1") 710 from the PMIC 702 to the gate driver 706 of the active matrix display. The circuitry further comprises a second switch ("SW2") 712 (which, as shown, is "open") positioned on the gate on voltage line 704. SW2 712 engages a pulldown resistor R 708 and a Zener diode 714. During the discharge phase, when SW1 is open and SW2 is closed, the Zener diode quickly drops the gate on voltage value to a predetermined value ("breakdown voltage" value, described below) and the rate at which the voltage drops to this value is influenced by an optional resistor R 708.

A Zener diode is a commercially available diode which allows current to flow in the forward direction in the same manner as an ideal diode, but also, allows it to flow in the reverse direction when the voltage is above a certain value ("breakdown voltage"). Zener diodes are available with different breakdown voltages and may be selected based on the desired breakdown voltage value for a particular display. A Zener diode is non-linear between voltage and current, but is predictable in how it reacts to voltage and current. A Zener diode will quickly drop voltage when current is high but, once when the breakdown voltage is reached, the current shuts off. This is another way to quickly drop the gate on voltage value during the voltage decay phase. It may be desirable to use more than one Zener diode in place of the one shown in FIG. 7. It is common practice to use a series of two or more Zener diodes in order to achieve a desired voltage above which the series of Zener diodes will conduct current. A series of Zener diodes may be employed to gain flexibility in choosing the voltage above which the voltage is dropped through conduction through the Zener diodes. In this case, the effective "breakdown voltage" of such a series of Zener diodes is the sum of the "breakdown voltage" of each of the constituent Zener diodes.

This circuit has advantages over previous versions. In previous versions, the SW2 is "single pole, double throw" switch and relies upon capacitor value to achieve a desired voltage at the start of the post-drive discharge session. In this version, SW2 is a "single pole, single throw" switch, which is much simpler. It uses a Zener diode to control the desired voltage, which gives more certain control of the voltage during the discharge phase than the circuits that employ capacitors to control the voltage during the discharge phase. The resistor in the diagram is optional. We perhaps should show this example but also show one without the resistor or explain that the resistor value could be zero.

According to another embodiment of the invention, the power management circuitry (such as a power management integrated circuit, PMIC) may be configured to actively control the gate on voltage. During an active update, the gate on value may be set to allow pixels to be sufficiently charged to desired voltages for successful display operation. After an active update, during the time of post-drive discharge, the gate on voltage may be set to a reduced value where the lower magnitude is sufficient to achieve post-drive discharging. The PMIC manages the gate on voltage control using a switch that switches the gate on voltage output to the display between a voltage value for actively driving the display and a different voltage value for post-drive discharging. In some embodiments, the switch is internal to the PMIC. In other embodiments, the switch and electrical circuitry is external to the PMIC.

Figure 8A:
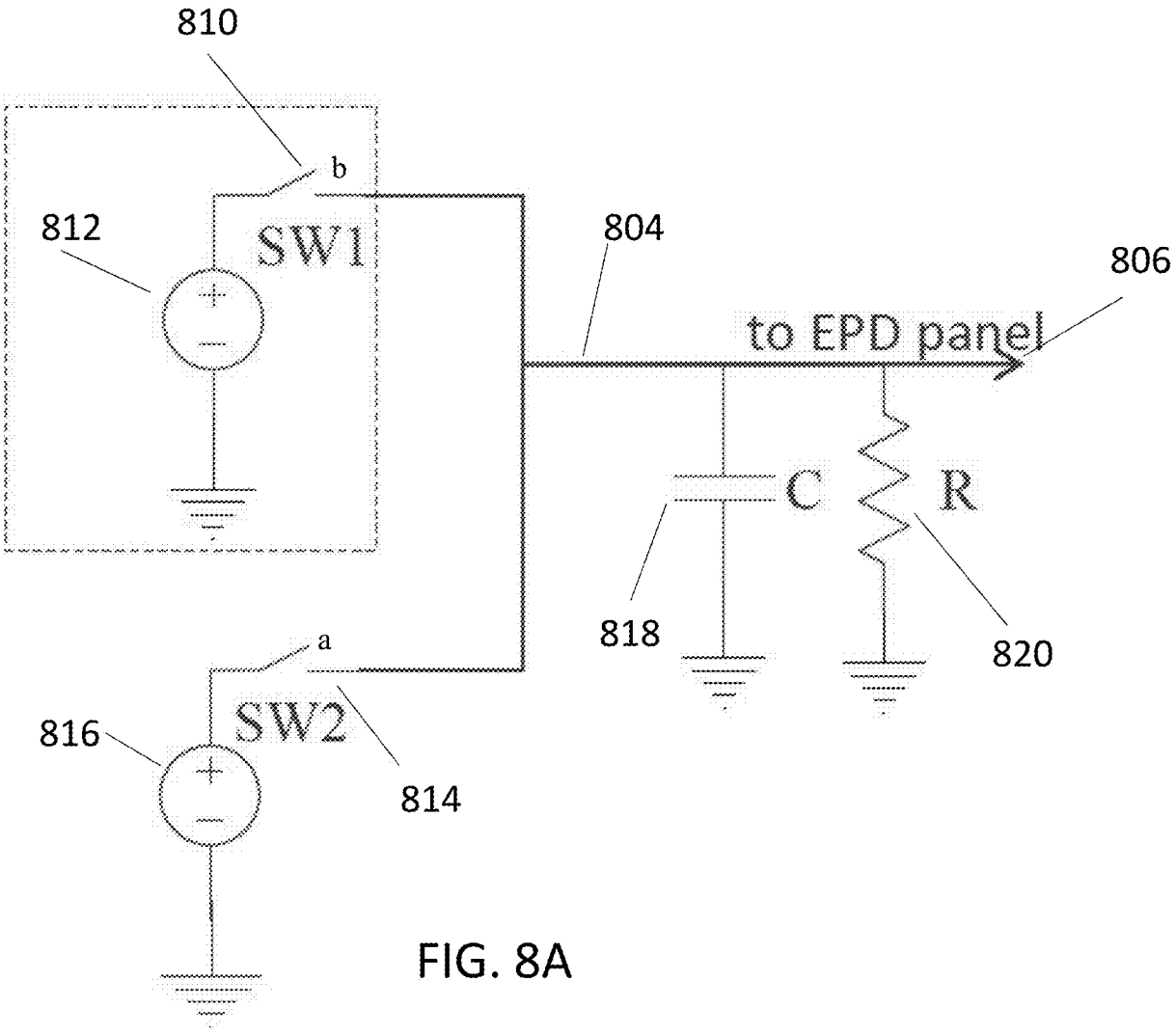
FIG. 8A is a schematic of a gate on voltage electrical circuit, including a resistor and a capacitor, of an electro-optic display, according to some embodiments.

FIG. 8A illustrates yet another embodiment in accordance with the present subject matter presented herein. FIG. 8A illustrates a gate on voltage line 804 coupled to a first switch ("SW1") 810 from a PMIC to the gate driver 806 of an active matrix display, the SW1 coupled to a first voltage source 812 configured to provide a first voltage to the display. In addition, a second voltage source 816, usually a low voltage source, may also be coupled to the gate on voltage line 804 through a second switch ("SW2") 814 and configured to provide a second voltage to the active matrix display. Furthermore, a capacitor C 818 and a resistor R 820 maybe connected in parallel in reference to the voltage line 804 and the gate driver 806 to provide greater control over the decay of the gate on voltage.

Figure 8B:
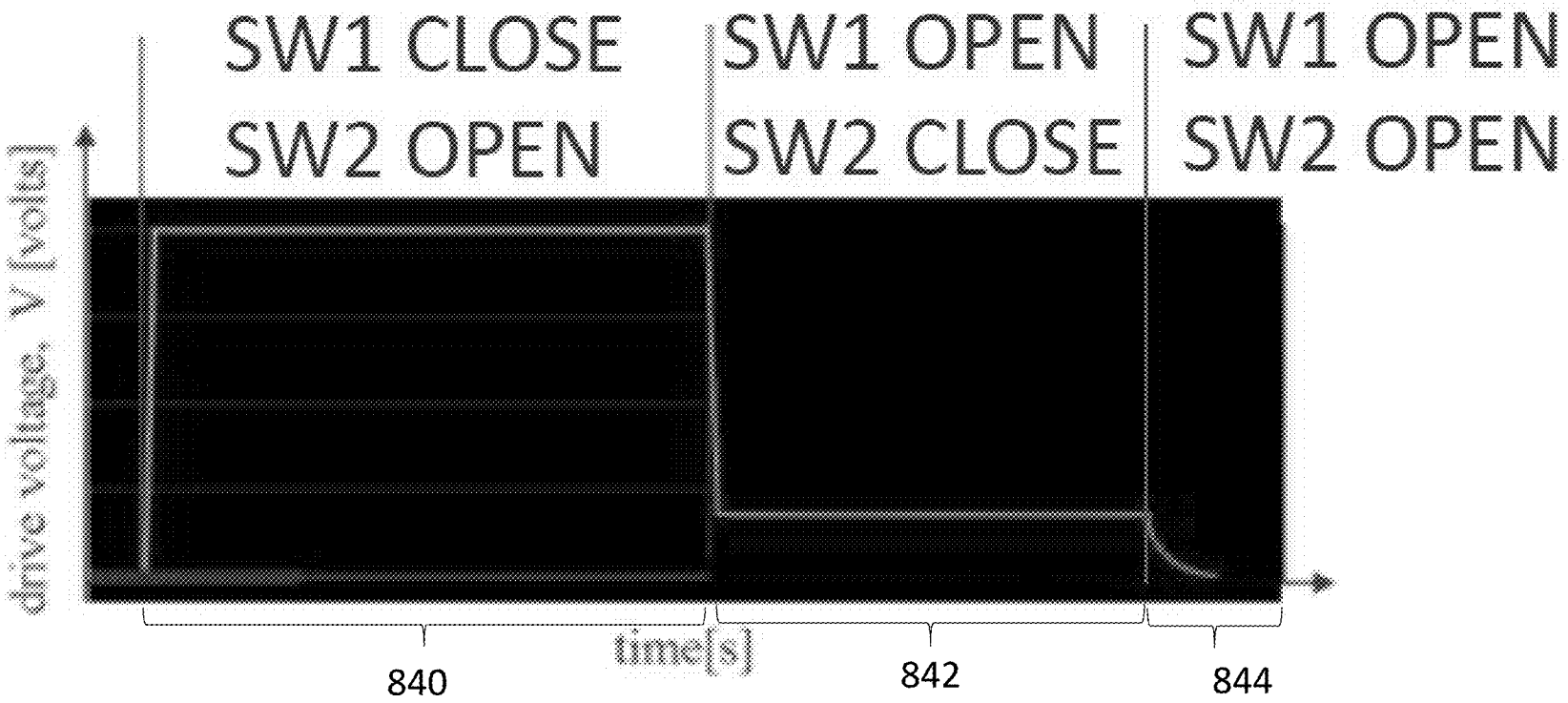
FIG. 8B is a graphical schematic depicting the gate on voltage over time for the circuit of FIG. 8A, according to some embodiments.

FIG. 8B illustrates the decay of the gate on voltage as configured by the circuit illustrated in FIG. 8A. As shown, during an active phase 840 (When SW1 is closed and SW2 is in a position "a"), the PMIC drives the display at the active drive gate on voltage value and charges capacitor C 818. During a second active phase 842 (When SW1 is in a position "b" and SW2 is closed), the PMIC drives the display at a voltage that dictated by the second voltage source 816. In this second active phase 842, the display is driven at a voltage level approximate to the voltage value supplied by the second voltage source 816, and the capacitor C 818 is charged or discharged accordingly in reference to the second voltage source 816's voltage value. Finally, during a discharge phase 844 (When SW1 is in position "b" and SW2 is in position "a"), the gate on voltage is designed to decay at a rate determined by a combination of capacitor C 818 and Resistor R 820. This configuration allows for a faster initial reduction in the gate on voltage and thus expedites the overall decay process and improves the device reliability.

Figure 9:
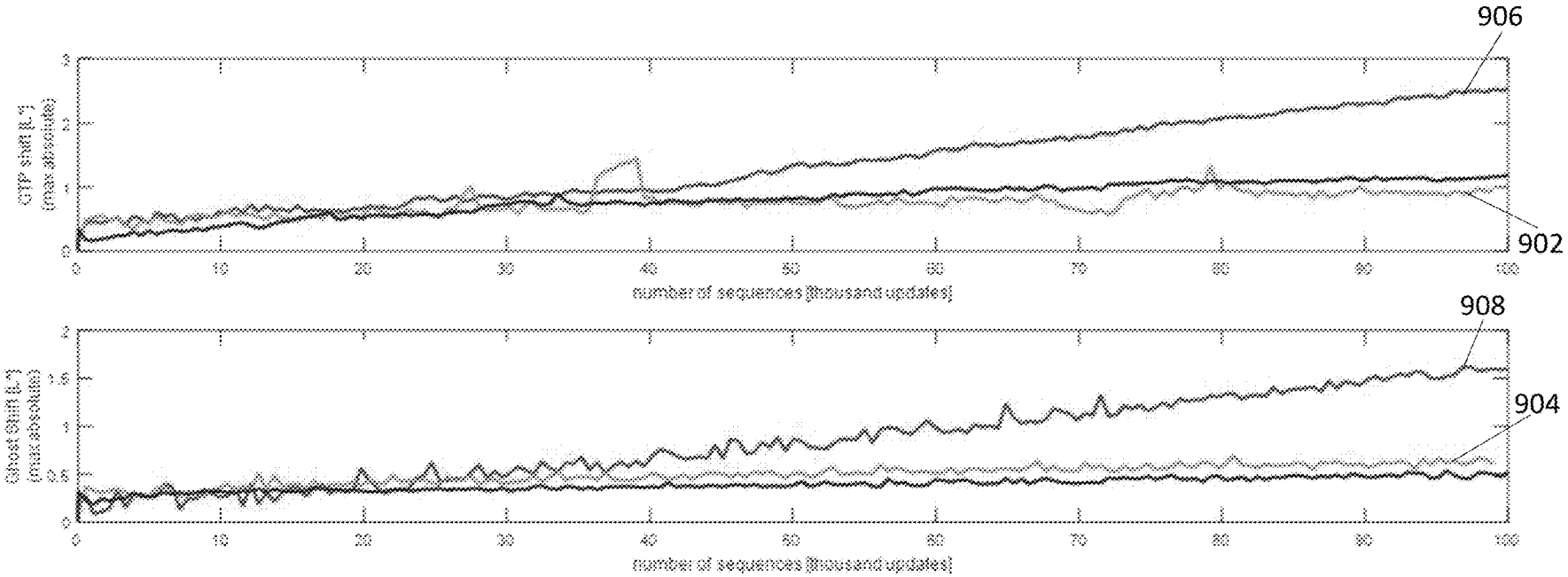
FIG. 9 is a graphical illustration of a comparison on the performances of the device illustrated in FIG. 8A to a conventional device.

In use, as illustrated in FIG. 9, after a long periods of usage (e.g., 100 thousand updates), the configuration illustrated in FIG. 8A provides for a better reliability (lines 902 and 904) than some conventional configurations (lines 906 and 908).

Transistors and Typical Charge Ratios/Transistor Degradation

Accordingly, in some aspects, the subject matter described herein also provides methods of driving a bistable electro-optic display having a plurality of pixels in an active matrix array. Various types of active matrix transistors are available commercially, including amorphous silicon, microcrystalline, polysilicon, and organic among others. Transistors in an active matrix display are typically designed to support an ON:OFF ratio of 1:1000 as most active matrix displays have about 1000 rows. For n-channel ("n-type") amorphous silicon thin film transistor ("a-Si TFT") in an active matrix display, the transistor is in its ON state (row is selected) when there is a positive voltage on the gate-to-source and is in its OFF state when there is a negative voltage on the gate-to-source. Thus, n-type thin film pixel transistors typically experience a positive to negative charge ratio of 1:1000. For p-channel ("p-type") a-Si TFT in an active matrix display, the voltage polarity is reversed. The p-type transistor is in its ON state when there is a negative voltage on the gate-to-source and is in its OFF state when there is a positive voltage on the gate-to-source. Thus, p-type thin film pixel transistors typically experience a negative to positive charge ratio of 1:1000. When the ON:OFF ratio is altered so that the transistor is ON more often than the normal ratio, the transistor may degrade and adversely affect the optical performance of the display. Amorphous silicon transistors are highly susceptible to degradation due to atypical charge biasing. One method for reducing this type of transistor degradation is to standardize the ON:OFF ratio by turning the transistor to its OFF position so that the ON:OFF ratio will be closer to its typical value of 1:1000, as described more fully herein.

It should be appreciated that the typical ON:OFF ratio of an active matrix display may differ from the 1:1000 ratio and that the aspects of the invention described herein still apply.

Charge Biasing Based on Reducing Remnant Voltage of an Electro-Optic Display

Charge biasing may occur when remnant voltage is discharged from electro-optic displays according to techniques disclosed herein and more fully disclosed in U.S. Provisional Application 62/111,927, filed Feb. 4, 2015, the entire contents are herein incorporated by reference. A remnant voltage of a pixel of an electro-optic display may be discharged by activating the pixel's transistor (i.e., turning all transistors ON) and setting the voltages of the front and rear electrodes of the pixel to approximately a same value for a period of time. The amount of remnant voltage discharged by a pixel during a remnant voltage discharge pulse may depend, at least in part, on the rate at which the pixel discharges the remnant voltage, and on the duration of the remnant voltage discharge pulse. In some embodiments, the duration of the period during which a remnant voltage discharge pulse is applied (in the ON position) may be at least 50 ms, at least 100 ms, at least 300 ms, at least 500 ms, at least 1 sec or any other suitable duration.

For example, all pixel transistors may be brought into conduction by bringing gate line voltage relative to the source line voltages to values that bring pixel transistors to a state where they are relatively conductive compared to the non-conductive state used to isolate pixels from source lines as part of normal active-matrix drive. For n-type thin film pixel transistors, this may be achieved by bringing gate lines to values substantially higher than source line voltage values. For p-type thin film pixel transistors, this may be achieved by bringing gate lines to values substantially lower than source line voltage values. In an alternative embodiment, all pixel transistors may be brought into conduction by bringing gate line voltages to zero and source line voltages to a negative (or, for p-type transistors, a positive) voltage.

Alternatively, a specially designed circuitry may provide for addressing all pixels at the same time. In a standard active-matrix operation, select line control circuitry typically does not bring all gate lines to values that achieve the above-mentioned conduction state for all pixel transistors. A convenient way to achieve this condition is afforded by select line driver chips that have an input control line that allows an external signal to impose a condition where all select line outputs receive a voltage supplied to the select driver chosen to bring pixel transistors into conduction. By applying the appropriate voltage value to this special input control line, all transistors may be brought into conduction. By way of example, for displays that have n-type pixel transistors, some select drivers have a "Xon" control line input. By choosing a voltage value to input to the Xon pin input to the select drivers, the "gate high" voltage is routed to all the select lines and turns all transistors to the ON state.

When remnant voltage is dissipated using these techniques, the positive to negative charge ratio experienced by, for example, the n-type transistors may change from approximately 1:1000 to approximately 1:10 or even 1:1. This atypical charge bias may cause transistor degradation and reduced display performance. With increased atypical charge biasing and transistor degradation, over time, the current and voltage ("IV") curve of a display shifts in value. If the IV curve shifts to a higher value, more voltage is needed to activate the transistor switch. The effect of the shift in the IV curve may be shown by optically measuring resultant graytone shift and ghosting shift in display reflectance (measured in L-star value (L*)).

Graytone Shift/Ghost Shift

There are usually 256 transitions defined which switch the display from 16 possible gray states (including extreme black and extreme white) currently on the display to the same gray states in the next image to be displayed. Graytone shift measures 16 of these transitions. Ghost shift measures a property of the remaining 240 transitions.

Figures 10A, 10B:
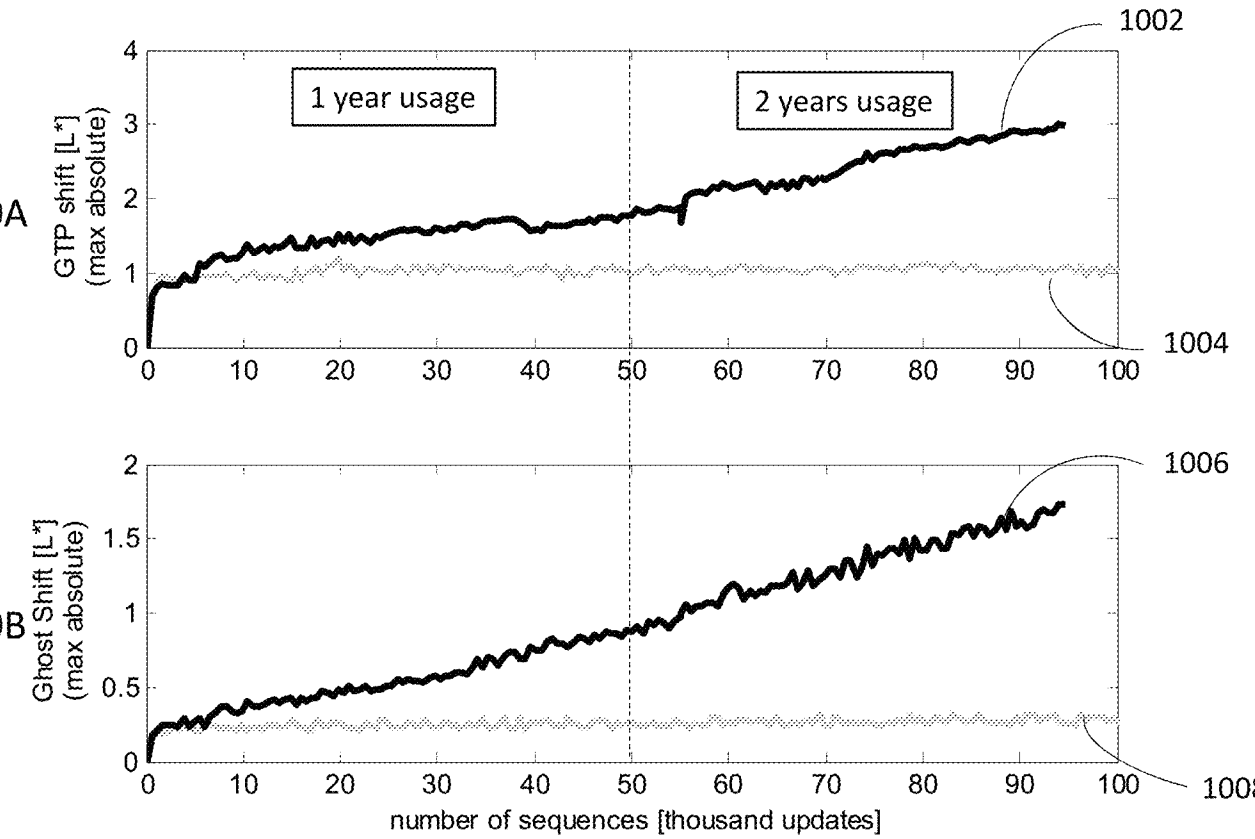
FIG. 10A is a graph showing the maximum graytone shift against a number of updates with and without remnant voltage discharging, according to some embodiments.
FIG. 10B is a graph showing the maximum ghost shift against a number of updates with and without remnant discharging, according to some embodiments.

Graytone Placement ("GTP") measures the optical state resulting from applying the 16 transitions to all possible graytones (including black and white) when starting from a white image. As shown in FIG. 10A, graytone placement shift is the absolute value of the maximum L* shift over the 16 graytones at time k, which may be defined by the number of sequences, minus the graytone shift at time zero. GTP shift, also referred to herein as graytone shift, may be calculated using the equation: GTP shift (k)=max|(GTP(k)−GTP(0))|, where GTP(0) is the initial GTP and GTP(k) is the GTP measurement at time k. GTP shift is an absolute measurement of the 16 transitions.

Ghosting measures the remaining 240 transitions from all possible 16 graytones except white to all possible 16 graytones, and subtracts the GTP value for the final displayed graytone. That is, the ghost measurement compares the optical state of a graytone when it transitions from a non-white graytone to the optical state of that same graytone when it transitions from white. As shown in FIG. 10B, ghost shift is the absolute value of the maximum ghosting at time k, which may be defined by the number of sequences, minus the ghosting at time zero. Ghost shift may be calculated using the equation: GHOST shift (k)=max|(GHOST(k)−GHOST(0))|, where GHOST(0) is the initial ghost measurement and GHOST(k) is the ghost measurement at time k. Ghost shift is a relative measurement based on GTP values.

Prior to taking measurements for GTP shift and ghost shift as shown in FIGS. 10A, 10B, 11A and 11B, the display was cleared by switching the display from its current state to black, white, white, white. However, any display clearing technique may be used as long as it is consistent so that measured values will be comparable.

The various aspects described above, as well as further aspects, will now be described in detail below. It should be appreciated that these aspects may be used alone, all together, or in any combination of two or more, to the extent that they are not mutually exclusive.

FIG. 10A is a graph showing the results of an accelerated reliability test at 45 degrees Celsius measuring the optical response shift by maximum absolute graytone shift against the number of updates with remnant voltage discharging 1002 and without remnant voltage discharging 1004, according to some embodiments. Each usage year is assumed to have 50,000 updates. As shown in FIG. 10A, the additional ON time the transistor experiences as a result of the remnant voltage discharging (atypical charge biasing) results in a significant graytone shift of approximately 2 L* after approximately 100,000 updates (or over approximately two years).

FIG. 10B is a graph showing the results of an accelerated reliability test at 45 degrees Celsius measuring the optical response shift by maximum absolute ghost shift against the number of updates with remnant voltage discharging 1006 and without remnant voltage discharging 1008, according to some embodiments. Each usage year is assumed to have 50,000 updates. As shown in FIG. 10B, the additional ON time the transistor experiences as a result of the remnant voltage discharging (atypical charge biasing) results in a significant ghost shift of approximately 3 L* after approximately 100,000 updates (or over approximately two years).

Figures 11A, 11B:
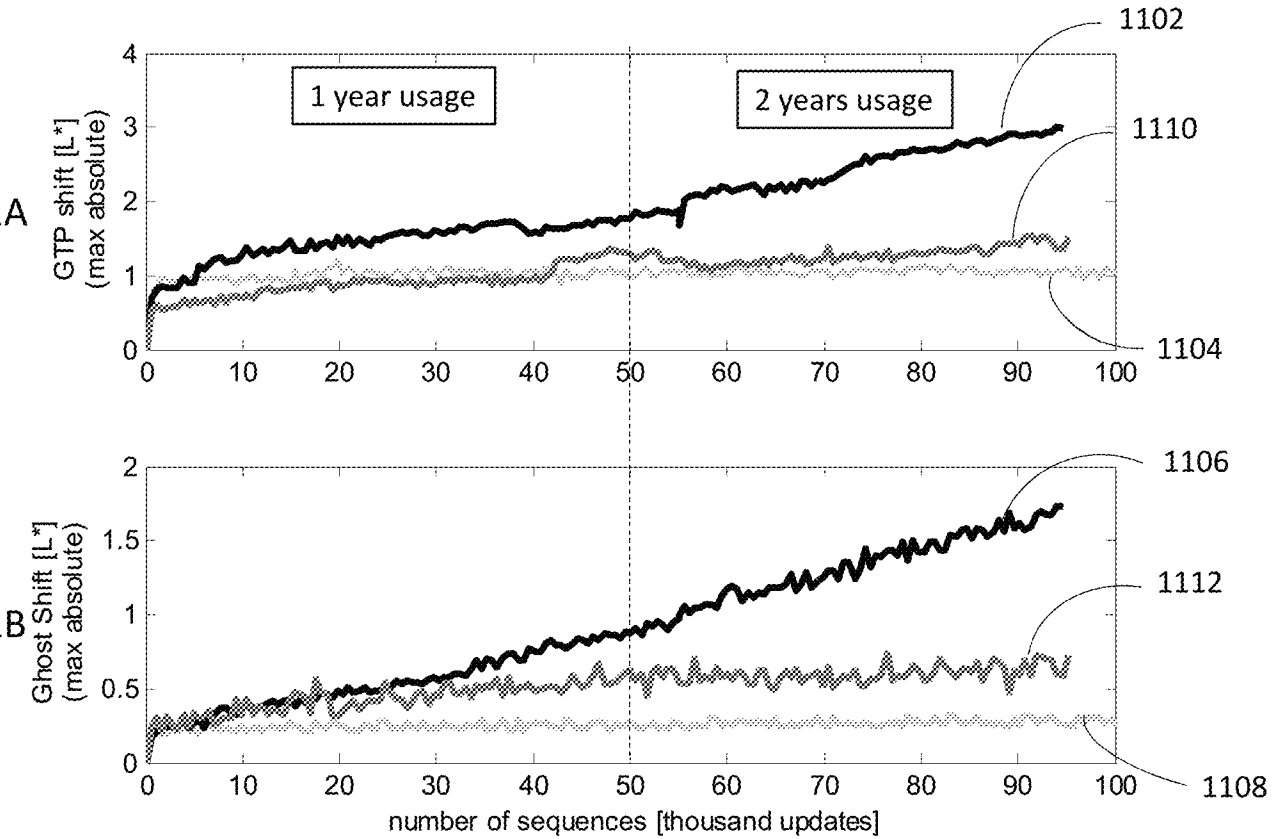
FIG. 11A is a graph showing the maximum graytone shift against a number of updates with remnant discharging, without remnant discharging, and with remnant discharging and negative biasing, according to some embodiments.
FIG. 11B is a graph showing the maximum ghost shift against a number of updates with remnant discharging, without remnant discharging, and with remnant voltage discharging and reduced charge biasing, according to some embodiments.

FIG. 11A is a graph showing the results of an accelerated reliability test at 45 degrees Celsius measuring the optical response shift by maximum absolute graytone shift against the number of updates with remnant voltage discharging 1102, without remnant voltage discharging 1104, and with remnant voltage discharging and standardization of the ON:OFF ratio 1110, according to some embodiments. Each usage year is assumed to have 50,000 updates. As shown in FIG. 11A, the additional ON time the transistor experiences as a result of the remnant voltage discharging 1102 (atypical charge biasing) results in a significant graytone shift of approximately 2 L* after approximately 100,000 updates (or over approximately two years) as compared to updates without the discharging 1104. When updates with remnant voltage discharging are standardized or offset by turning the transistors to the OFF position for an additional period of time 1110, the resulting of graytone shift after approximately 100,000 updates is only about 0.25 L* as compared to updates without the discharging 1104.

FIG. 11B is a graph showing the results of an accelerated reliability test at 45 degrees Celsius measuring the optical response shift by maximum absolute ghost shift against the number of updates with remnant voltage discharging 1106, without remnant voltage discharging 1108, and with remnant voltage discharging and standardization of the ON:OFF ratio 1112, according to some embodiments. Each usage year is assumed to have 50,000 updates. As shown in FIG. 11B, the additional ON time the transistor experiences as a result of the remnant voltage discharging 1106 (atypical charge biasing) results in a significant ghost shift of approximately 3 L* after approximately 100,000 updates (or over approximately two years) as compared to updates without the discharging 1108. When updates with remnant voltage discharging are standardized or offset by turning the transistors to the OFF position for an additional period of time 1112, the resulting of ghost shift after approximately 100,000 updates is only about 0.75 L* as compared to updates without the discharging 1108.

Figures 12A, 12B:
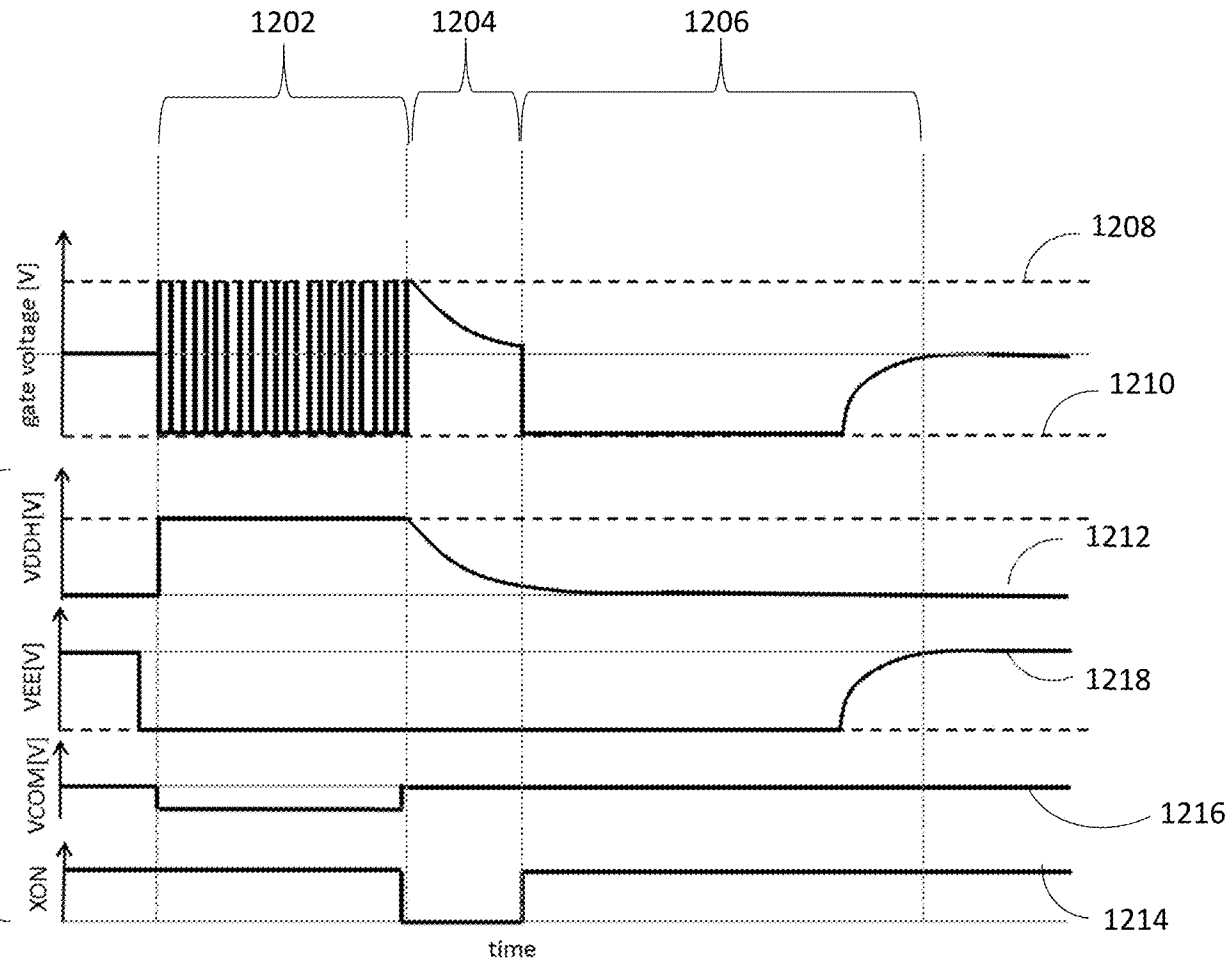
FIG. 12A is a schematic of a signal-timing diagram showing the gate voltage against time, according to some embodiments.
FIG. 12B is a schematic of a signal-timing diagram showing voltages against time, according to some embodiments.

FIG. 12A is a schematic signal-timing diagram showing the gate voltage against time, according to some embodiments. FIG. 12A depicts applied gate voltage over time diagram for one optical update, which includes an active update period 1202—each positive and negative transition reflects a single frame in a series of multiple frames during the active update period, an remnant voltage discharge (ON state) period 1204, and an OFF state period, in an active matrix display having n-type transistors. In an n-type transistor, a positive gate voltage is applied to achieve an ON state 1204 while a negative voltage is applied to achieve an OFF state 1206. In one embodiment, the active update period may be 500 ms, the ON period may be 1 sec, and the OFF period may be 2 secs. These time periods may vary depending display usage and/or the number of optical updates required within a defined time period, for example, per minute, per hour, etc. As depicted, the remnant voltage discharge pulse (ON state) 1204 is run after the active update (i.e., optical update) 302 to drain residual charge. The OFF state is run after the ON state to achieve an ON:OFF ratio closer to the typical 1:1000 ratio. While the 1:1000 ratio may not be achieved, an ON:OFF ratio that approximates the 1:1000 ratio, even if it is only 1:10, will reduce transistor degradation.

FIG. 12B is a schematic signal-timing diagram showing multiple voltages against time with a display utilizing an Xon connection to turn ON all transistors simultaneously, according to some embodiments. FIG. 12B depicts applied voltages over time diagram for one optical update, which includes an active update period 1202, a remnant voltage discharge (ON state) period 1204, and an OFF state period, in an active matrix display having n-type transistors. The four voltages shown are high level gate line voltage ("VDDH") 1212, low level gate line voltage ("VEE") 1218, front electrode voltage ("VCOM") 1216 and Xon voltage 1214. Each voltage has a separate zero voltage axis which is depicted as a solid gray line. Voltages above the solid gray line indicate positive voltages while voltages below the solid gray line indicate negative voltages. In FIG. 12B, the overall gate voltage depicted in FIG. 12A is a combination of VDDH and VEE voltages. The gate driver output enabled voltage ("VGDOE") (not shown), which controls which gate voltage (i.e., VEE or VDDH) is applied. The Xon voltage activates all transistors simultaneously when brought to ground, which turns all transistors ON during the discharge period 1204. During the OFF state period 1206, VDDH is brought to ground and the transistors experience the applied VEE (negative voltage), which is controlled to approach zero towards the end of the period. By turning the transistor to its OFF position for an additional period of time, the ON:OFF ratio more closely reflects its typical value of 1:1000. While maintaining the ON:OFF ratio at 1:1000 is preferred, any ON:OFF period that moves the ratio towards its typical value, even if it is only 1:10, 1:50 or 1:100, may prevent transistor degradation.

The OFF period adds time to each update. Thus, the OFF period may be preassigned a definite amount of time, may be determined by a controller based on the frequency of updates and/or may be interrupted. The OFF period preferably occurs after the ON period, but may occur at other times, including before an active update period. The OFF period may range from 500 ms to 4 sec, preferably from 1 sec to 2 secs. Depending on the optical update time and the number of optical updates over a period of time, the OFF period may be extended to up to 10 secs.

Further Embodiments for Reducing Electrochemical Stress in Electro-Optic Displays As previously indicated above, electro-optic displays can include display controller circuitry including power management circuitry for applying voltage waveforms to the display pixels sufficient to change the optical state of the electrophoretic display medium in proximity to the display pixels. One of skill in the art will appreciate that the display controller circuitry of the present invention can be implemented in a number of different physical forms and can utilize a variety of analog and digital components. For example, the display controller circuitry can include a general purpose microprocessor in conjunction with appropriate peripheral components (for example, one or more digital-to-analog converters, "DACs") to convert the digital outputs from the microprocessor to appropriate voltages for application to pixels. Alternatively, the display controller circuitry can be implemented in an application specific integrated circuit ("ASIC") or field programmable gate array ("FPGA"). One of skill in the art will appreciate that the display controller circuitry can include both processing components and power management circuitry such as the PMIC described above.

In some embodiments, the display controller circuitry includes a timing controller integrated circuit ("IC") that accepts incoming image data and outputs control signals to a collection of data and select driver ICs in order to produce the proper voltages at the pixels to display the desired image. In some embodiments, a host controller in communication with the display controller circuit requests an update to the display and supplies the image data for the update to the display controller circuit. In some embodiments, the display controller circuitry accepts the image data through access to a memory buffer that contains the image data, or receives a signal from which the image data is extracted. In some embodiments, the memory buffer has a structure such as those described in the afore-referenced U.S. Pat. No. 9,721,495. In some embodiments, the display controller circuitry receives serial signals containing the information required to perform the necessary calculations to generate drive impulses (e.g., driving waveforms) to apply to the electrophoretic medium during scans of the pixel array.

Due to the properties of the electrophoretic medium, in most practical cases several complete scans of the display pixel array are required to complete an image update. The driving portion of each series of scans required for an image update is typically an uninterruptible unit, meaning that once the display controller circuit has begun performing an active update of the display it must complete that update before performing any subsequent updates of the display.

As discussed in detail above, having the display controller hold the pixel transistors in a conducting state for an extended duration of time in order to discharge remnant voltage can cause pixel transistor bias stress which leads to transistor degradation and, over time, a shift in the transistor current and voltage ("IV") curve that can adversely affect the optical performance of the display. Accordingly, many conventional display controllers are configured to perform post-drive discharging just once after each active update of the display, but are not programmed with a dedicated function or command to cause post-drive discharge in the absence of an active update. However, after post-drive discharging has ended, there may still be remnant voltage present on the display pixels. It can therefore be advantageous to also run post-drive discharge at a time when a pixel or a group of pixels has been idle and no active updates to the display are scheduled. For example, for a display used as an electronic book reader, there can be tens of seconds to several minutes before a user-requested page turn input or "swipe" is received, triggering the display controller circuit to perform an active update of the display to effectively turn the page.

It is possible to induce a conventional display controller to perform post-drive discharge on demand by requesting one or more active updates to provide driving waveforms that leave the pixels in their current state. After each such update, the display controller performs post-drive discharging. However, the driving waveforms provided during active updates are typically long in duration and are typically not interruptible. For example, a single frame can be approximately 2-20 milliseconds (msec) in duration, and there can be as many as 1000 frames in a driving waveform, but usually a driving waveform is made up of 20-40 frames. Accordingly, invoking post-drive discharge on demand requires the display controller to first apply an uninterruptible driving waveform lasting on the order of hundreds of milliseconds. In the event a user-requested page turn input was received after commencing the driving waveform, a delay of such a length would be perceptible to a user, and would therefore negatively impact the user experience.

Adding a dedicated function or command to a conventional display controller circuit to cause it to enter post-drive discharge in the absence of an active update is typically complex or not feasible, especially after field deployment of the display. As noted above, the display controller functionality is typically implemented in one or more integrated circuits such as DACs, ASICs, and data and select driver ICs. The functionality of such devices is fixed, meaning additional features or commands cannot be added. Even when the display controller functionality is implemented in an FPGA, which can be reconfigured with additional functionality after deployment, updating the FPGA's firmware device image to add features typically requires manual reprogramming by a field technician.

Accordingly, one aspect of the invention described herein provides a method for driving an electro-optic display that enables the display controller circuitry to enter post-drive discharge in the absence of an active update, thereby further discharging harmful remnant voltage.

Figure 13:
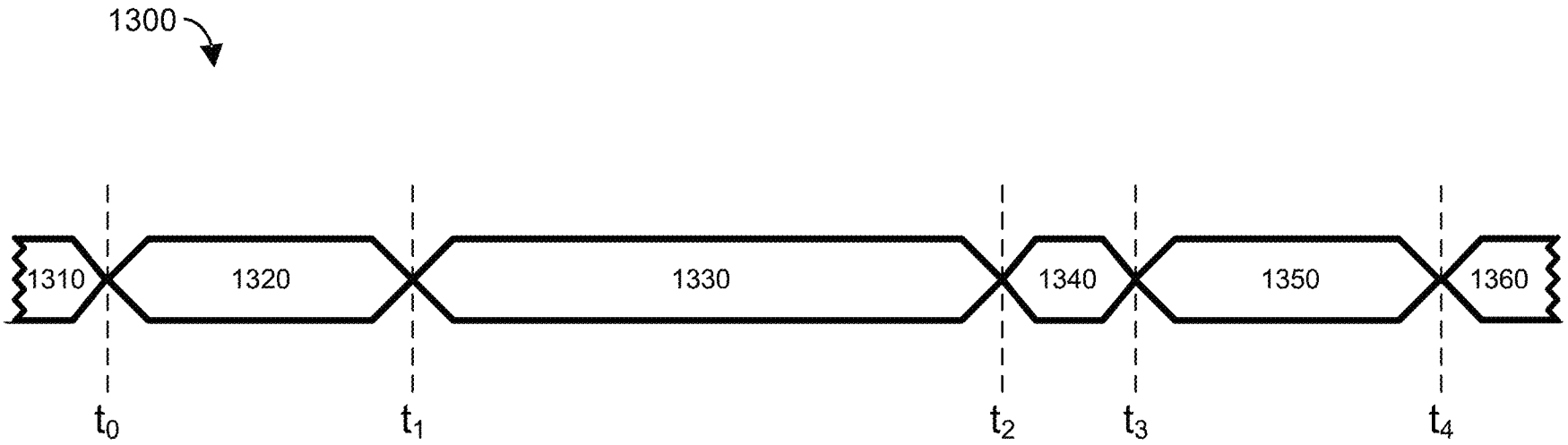
FIG. 13 is a schematic of a state-timing diagram showing operational states of the electro-optic display over several periods of time, according to some embodiments.

FIG. 13 is a schematic of a state-timing diagram 1300 showing operational states of the electro-optic display over several periods of time, according to some embodiments of the invention. It is again noted that the figures of the application are not necessarily drawn to scale, and the length of each operational state as shown in FIG. 13 does not reflect its actual duration in time relative to the other operational states shown.

Referring to FIG. 13, operational state 1310 is an active update that is completing at time to at which time the display controller circuit performs a post-drive discharge phase during operational state 1320. Upon completion of the post-drive discharge phase at time $t_1$, there are no pending updates to the display and operational state 1330 represents a dwell or idle period during which no driving voltages are applied and the display pixels are allowed to remain at their current optical state. In some embodiments, the display controller circuit places the display pixels in an electrically-floating state during the dwell or idle period. Each display pixel can be placed in an electrically-floating state using any suitable technique, including, without limitation, setting the voltage applied to the gate of the pixel transistor to a value suitable for de-activating the pixel transistor, and placing the common electrode in a high-impedance state.

At time $t_2$, the display controller detects that a display pixel or group of display pixels has been in an idle state for a first period of time since a driving waveform and post-drive discharge phase have been applied (i.e., the period of time that has elapsed between time $t_1$ and time $t_2$), and that there are no pending requests to apply a driving waveform to the display pixel or group of display pixels. In some embodiments, the display controller circuit detects that a pixel or group of pixels is in an idle state by determining that a memory buffer used to provide data for display updates is empty. In some embodiments, the display controller circuit receives a signal or semaphore indicating that there are no pending requests to update the display.

Accordingly, at time $t_2$ the display enters operational state 1340 during which the display controller circuit is configured to apply a null black or null transition waveform to the display pixel or group of display pixels. In some embodiments, the null transition waveform consists of a single frame, and application of the null transition waveform to a display pixel does not alter its the optical state. In some embodiments, the null transition waveform has a duration of between 10 ms and 20 ms. In some embodiments, during a null transition waveform the display controller circuit applies a substantially equal voltage to the common electrode and the display pixel electrode, and also applies a gate on voltage to the n-type transistor sufficient to create a conduction path through the n-type transistor. In some embodiments, during a null transition waveform the display controller circuit applies substantially zero volts the common electrode and the display pixel electrode.

Upon completion of the null transition waveform at time $t_3$, the display controller circuit is configured to automatically enter operational state 1350 during which the display controller invokes post-drive waveform sequence in response to the null transition waveform. In some embodiments, the post-drive waveform sequence is identical to the post-drive discharge phase performed during operational state 1320.

Finally, upon completion of the post-drive waveform sequence at time $t_4$, the display transitions to operational state 1360 during which the display pixel or group of display pixels is returned to an idle state until the next update request is received.

Accordingly, the method described herein can induce a conventional display controller to perform a post-drive discharge phase on demand without requiring custom hardware or field reconfiguration of the display controller. For example, driving waveforms are typically defined in software running on a host device that provides them to the display controller. Creating a custom waveform (i.e., the null transition waveform) that is only a single frame long is a minor change to make in software, and because the display controller is configured to perform post-drive discharge after any driving waveform, application of the null transition waveform triggers post-drive discharge.

The inventive method advantageously provides a mechanism for causing a conventional display controller to perform a post-drive discharge phase on demand after an exceedingly short waveform. As noted above, the driving portion of each series of scans required for an image update is typically an uninterruptible unit. (For example, an update request received between time $t_2$ and $t_3$ would not be serviced until time $t_3$, but an update request received between time $t_3$ and $t_4$ would be serviced immediately.) However, while the null transition waveform is treated as a driving waveform and is therefore not interruptible, it is short enough in duration to be imperceptible to a user in the event a page turn was requested during the null transition waveform. This provides an enhanced user experience by allowing the remnant voltage to be sporadically drained with no risk of holding up a requested update, while simultaneously extending the useable life of the display pixel transistors.

In some embodiments, in response to the null transition waveform the display controller circuit is configured to invoke a post-drive waveform sequence that includes applying substantially zero volts to the common electrode and the display pixel electrode, and applying a gate off voltage to the n-type transistor that is a negative voltage sufficient to prevent formation of a conduction path through the n-type transistor. Such a sequence can reduce transistor transconductance stress that can occur when discharge voltages are applied to transistor gates during a discharge of remnant voltage. The transconductance stress can accumulate over time and cause degradations in display performance. Accordingly, the gate off voltage can reduce a bias stress on the n-type transistor, and shift a transconductance value of the n-type transistor. In some embodiments, the negative gate off voltage results in a current leakage path within the n-type transistor that discharges remnant charge from the electrophoretic display medium.

In some embodiments, in response to the null transition waveform the display controller circuit is configured to invoke a post-drive waveform sequence consisting of: (i) applying substantially zero volts to the common electrode and the display pixel electrode, (ii) applying, for a first post-drive period of time, a gate on voltage to a gate electrode of the n-type transistor where the gate on voltage is a positive voltage sufficient to create a conduction path through the n-type transistor for discharging a remnant charge from the electrophoretic display medium, (iii) applying, for a second post-drive period of time, a gate off voltage to a gate electrode of the n-type transistor where the gate off voltage is a negative voltage sufficient to prevent formation of a conduction path through the n-type transistor, and (iv) returning the display pixel to the idle state. Such an embodiment can result in a good balance between actively draining remnant voltage during the gate on period, and shifting a transconductance value of the transistor during the gate off period.

Further Description of Some Embodiments

It should be understood that the various embodiments shown in the Figures are illustrative representations, and are not necessarily drawn to scale. Reference throughout the specification to "one embodiment" or "an embodiment" or "some embodiments" means that a particular feature, structure, material, or characteristic described in connection with the embodiment(s) is included in at least one embodiment, but not necessarily in all embodiments. Consequently, appearances of the phrases "in one embodiment," "in an embodiment," or "in some embodiments" in various places throughout the Specification are not necessarily referring to the same embodiment.

Unless the context clearly requires otherwise, throughout the disclosure, the words "comprise," "comprising," and the like are to be construed in an inclusive sense as opposed to an exclusive or exhaustive sense; that is to say, in a sense of "including, but not limited to." Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list; all of the items in the list; and any combination of the items in the list.

Having thus described several aspects of at least one embodiment of the technology, it is to be appreciated that various alterations, modifications, and improvements will readily occur to those skilled in the art. Such alterations, modifications, and improvements are intended to be within the spirit and scope of the technology. Accordingly, the foregoing description and drawings provide non-limiting examples only.

The invention claimed is:

1. An electro-optic display comprising:

an electrophoretic display medium electrically coupled between a common electrode and a display pixel electrode associated with a display pixel;

a display controller circuit in electrical communication with the common electrode and an n-type transistor associated with the display pixel electrode, the display controller circuit capable of applying waveforms comprising one or more frames to the display pixel by applying one or more voltages to the common electrode and to the display pixel electrode via the n-type transistor, wherein the one or more voltages are sufficient to change an optical state of the electrophoretic display medium in proximity to the display pixel, the display controller circuit configured to:

detect the display pixel is in an idle state;

apply a null transition waveform to the display pixel, the null transition waveform consisting of a single frame; and invoke automatically, in response to the null transition waveform, a first post-drive waveform sequence.

2. The electro-optic display of claim 1 wherein determining the display pixel is in an idle state further comprises:

determining a first period of time has elapsed since a driving waveform has been applied to the display pixel; and determining there are no pending requests to apply a driving waveform to the display pixel.

3. The electro-optic display of claim 1 wherein the display controller circuit is further configured to:

receive a request to update the display pixel during the null transition waveform;

complete the null transition waveform;

bypass the post-drive waveform sequence; and apply a driving waveform to the display pixel according to the request.

4. The electro-optic display of claim 1 wherein the display controller circuit is further configured to:

receive a request to update the display pixel during the first post-drive waveform sequence;

interrupt the first post-drive waveform sequence; and apply a driving waveform to the display pixel according to the request.

5. The electro-optic display of claim 1 wherein invoking the first post-drive waveform sequence comprises:

applying substantially zero volts to the common electrode and the display pixel electrode; and applying a gate on voltage to a gate electrode of the n-type transistor, wherein the gate on voltage is a positive voltage sufficient to create a conduction path through the n-type transistor for discharging a remnant charge from the electrophoretic display medium.

6. The electro-optic display of claim 1 wherein invoking the first post-drive waveform sequence comprises:

applying substantially zero volts to the common electrode and the display pixel electrode; and applying a gate off voltage to a gate electrode of the n-type transistor, wherein the gate off voltage is a negative voltage sufficient to prevent formation of a conduction path through the n-type transistor.

7. The electro-optic display of claim 6 wherein the gate off voltage is configured to reduce a bias stress on the n-type transistor.

8. The electro-optic display of claim 6 wherein the gate off voltage is configured to shift a transconductance value of the n-type transistor.

9. The electro-optic display of claim 6 wherein invoking the first post-drive waveform sequence further comprises discharging a remnant charge from the electrophoretic display medium through a current leakage path within the n-type transistor.

10. The electro-optic display of claim 1 wherein invoking the first post-drive waveform sequence consists of:

applying substantially zero volts to the common electrode and the display pixel electrode;

applying, for a first post-drive period of time, a gate on voltage to a gate electrode of the n-type transistor, wherein the gate on voltage is a positive voltage sufficient to create a conduction path through the n-type transistor for discharging a remnant charge from the electrophoretic display medium;

applying, for a second post-drive period of time, a gate off voltage to a gate electrode of the n-type transistor, wherein the gate off voltage is a negative voltage sufficient to prevent formation of a conduction path through the n-type transistor; and returning the display pixel to the idle state.

11. The electro-optic display of claim 1 wherein the null transition waveform has a duration of between 10 ms and 20 ms.

12. The electro-optic display of claim 1 wherein applying a null transition waveform to the display pixel comprises:

applying a substantially equal voltage to the common electrode and the display pixel electrode; and applying a gate on voltage to a gate electrode of the n-type transistor, wherein the gate on voltage is a positive voltage sufficient to create a conduction path through the n-type transistor.

13. A method for driving an electro-optic display comprising an electrophoretic display medium electrically coupled between a common electrode and a display pixel, the display pixel associated with a display pixel electrode and an n-type transistor electrically coupled to a display controller circuit capable of applying waveforms comprising one or more frames to the display pixel by applying one or more voltages to the common electrode and to the display pixel electrode via the n-type transistor, wherein the one or more voltages are sufficient to change an optical state of the electrophoretic display medium in proximity to the display pixel, the method comprising the following steps in order:

detecting the display pixel is in an idle state;

applying a null transition waveform to the display pixel, the null transition waveform consisting of a single frame; and invoking automatically, in response to the null transition waveform, a first post-drive waveform sequence.

14. The method of claim 13 wherein determining the display pixel is in an idle state further comprises:

determining a first period of time has elapsed since a driving waveform has been applied to the display pixel; and determining there are no pending requests to apply a driving waveform to the display pixel.

15. The method of claim 13 further comprising:

receiving a request to update the display pixel during the null transition waveform;

completing the null transition waveform;

bypassing the post-drive waveform sequence; and applying a driving waveform to the display pixel according to the request.

16. The method of claim 13 further comprising:

receiving a request to update the display pixel during the first post-drive waveform sequence;

interrupting the first post-drive waveform sequence; and applying a driving waveform to the display pixel according to the request.

17. The method of claim 13 wherein invoking the first post-drive waveform sequence comprises:

applying substantially zero volts to the common electrode and the display pixel electrode; and applying a gate on voltage to a gate electrode of the n-type transistor, wherein the gate on voltage is a positive voltage sufficient to create a conduction path through the n-type transistor for discharging a remnant charge from the electrophoretic display medium.

18. The method of claim 13 wherein invoking the first post-drive waveform sequence comprises:

applying substantially zero volts to the common electrode and the display pixel electrode; and applying a gate off voltage to a gate electrode of the n-type transistor, wherein the gate off voltage is a negative voltage sufficient to prevent formation of a conduction path through the n-type transistor.

19. The method of claim 18 wherein the gate off voltage is configured to reduce a bias stress on the n-type transistor.

20. The method of claim 18 wherein the gate off voltage is configured to shift a transconductance value of the n-type transistor.

21. The method of claim 18 wherein invoking the first post-drive waveform sequence further comprises discharging a remnant charge from the electrophoretic display medium through a current leakage path within the n-type transistor.

22. The method of claim 13 wherein invoking the first post-drive waveform sequence consists of:

applying substantially zero volts to the common electrode and the display pixel electrode;

applying, for a first post-drive period of time, a gate on voltage to a gate electrode of the n-type transistor, wherein the gate on voltage is a positive voltage sufficient to create a conduction path through the n-type transistor for discharging a remnant charge from the electrophoretic display medium;

applying, for a second post-drive period of time, a gate off voltage to a gate electrode of the n-type transistor, wherein the gate off voltage is a negative voltage sufficient to prevent formation of a conduction path through the n-type transistor; and returning the display pixel to the idle state.

23. The method of claim 13 wherein the null transition waveform has a duration of between 10 ms and 20 ms.

24. The method of claim 13 wherein applying a null transition waveform to the display pixel comprises:

applying a substantially equal voltage to the common electrode and the display pixel electrode; and applying a gate on voltage to a gate electrode of the n-type transistor, wherein the gate on voltage is a positive voltage sufficient to create a conduction path through the n-type transistor.

* * * * *